US011060316B2

(12) United States Patent
Pescovitz

(10) Patent No.: US 11,060,316 B2
(45) Date of Patent: Jul. 13, 2021

(54) PERSONAL ENCLOSURE WITH INSERT

(71) Applicant: Under the Weather, LLC, Cincinnati, OH (US)

(72) Inventor: Eric Frank Pescovitz, Cincinnati, OH (US)

( * ) Notice: Subject to any disclaimer, the term of this patent is extended or adjusted under 35 U.S.C. 154(b) by 0 days.

(21) Appl. No.: 16/727,006

(22) Filed: Dec. 26, 2019

(65) Prior Publication Data

US 2020/0131797 A1 Apr. 30, 2020

Related U.S. Application Data

(63) Continuation of application No. 16/373,230, filed on Apr. 2, 2019, now abandoned, which is a continuation of application No. 15/949,033, filed on Apr. 9, 2018, now abandoned.

(60) Provisional application No. 62/482,920, filed on Apr. 7, 2017.

(51) Int. Cl.

| | |
|---|---|
| ***B65D 21/02*** | (2006.01) |
| ***E04H 15/40*** | (2006.01) |
| ***E04H 15/54*** | (2006.01) |
| *E04H 15/32* | (2006.01) |
| *E04H 15/58* | (2006.01) |
| *E04H 15/00* | (2006.01) |

(52) U.S. Cl.

CPC ..... *E04H 15/40* (2013.01); *B65D 21/0233* (2013.01); *E04H 15/405* (2013.01); *E04H 15/54* (2013.01); *E04H 15/001* (2013.01); *E04H 15/006* (2013.01); *E04H 15/32* (2013.01); *E04H 15/58* (2013.01)

(58) Field of Classification Search

CPC ..... E04H 15/18; E04H 15/40; E04H 15/405; E04H 15/006; B65D 21/00

USPC ..... 220/9.1–9.3

See application file for complete search history.

(56) References Cited

U.S. PATENT DOCUMENTS

| | | | | |
|---|---|---|---|---|
| 4,800,597 A * | 1/1989 | Healey | E04H 1/1277 | 135/97 |
| 6,554,013 B2 * | 4/2003 | Brown | A47K 3/286 | 135/156 |
| 7,040,333 B1 * | 5/2006 | Ransom | E04H 15/32 | 135/115 |

(Continued)

*Primary Examiner* — David R Dunn
*Assistant Examiner* — Danielle Jackson
(74) *Attorney, Agent, or Firm* — Benesch, Friedlander, Coplan & Aronoff LLP

(57) ABSTRACT

A collapsible enclosure and an insert, where the collapsible enclosure includes a body formed by a plurality of walls including a front, a back, a first side, a second side, a top, and a bottom wall coupled to one another to form an interior. Each wall includes at least one of a plurality of deformable frame members. A door is defined in one of the front, back, first side, and second side wall, and is further selectively engageable with the respective wall such that the door is disposable between an open and closed position. The insert includes a body formed by a plurality of walls including a front, a back, a first side, and a second side coupled to one another to form an interior. Each wall includes at least one of a plurality of deformable frame members. A door is defined in one of the front, back, first side, and second side wall, and is further selectively engageable with the respective wall such that the door is disposable between an open and closed position.

10 Claims, 45 Drawing Sheets

(56) References Cited

U.S. PATENT DOCUMENTS

| | | | | |
|---|---|---|---|---|
| 7,137,399 | B1 * | 11/2006 | Ransom | E04H 15/32 135/128 |
| 8,978,816 | B2 * | 3/2015 | Slotznick | E04B 1/99 181/30 |
| 9,103,137 | B2 * | 8/2015 | Williams | E04H 15/06 |
| 9,834,953 | B2 * | 12/2017 | Ways | E04H 15/425 |
| 10,233,665 | B1 * | 3/2019 | Lee | E04H 15/32 |
| 2007/0130844 | A1 * | 6/2007 | Arts | E04H 9/16 52/79.1 |
| 2007/0193614 | A1 * | 8/2007 | Egstad | E04H 15/001 135/156 |
| 2009/0188539 | A1 * | 7/2009 | Hollinger | E04H 15/32 135/115 |
| 2011/0174811 | A1 * | 7/2011 | Sabounjian | D06F 95/002 220/9.2 |
| 2016/0167832 | A1 * | 6/2016 | Silverman | D06F 95/002 220/9.2 |
| 2016/0208513 | A1 * | 7/2016 | Ways | E04H 15/44 |
| 2018/0073268 | A1 * | 3/2018 | Pescovitz | E04H 15/58 |
| 2018/0200639 | A1 * | 7/2018 | Chiang | E04H 15/006 |
| 2018/0291644 | A1 * | 10/2018 | Pescovitz | E04H 15/54 |
| 2019/0226228 | A1 * | 7/2019 | Pescovitz | E04H 15/32 |
| 2019/0330874 | A1 * | 10/2019 | Pescovitz | E04H 15/44 |

* cited by examiner

PERSONAL ENCLOSURE WITH INSERT

RELATED U.S. APPLICATION DATA

This application is a continuation of U.S. patent application Ser. No. 16/373,230, filed on Apr. 2, 2019, which is a continuation of U.S. patent application Ser. No. 15/949,033, filed on Apr. 9, 2018, which claims the benefit of priority to U.S. Provisional Patent Application Ser. No. 62/482,920, filed on Apr. 7, 2017, all of which are incorporated herein by reference in its entirety.

FIELD OF THE DISCLOSURE

The present disclosure relates to an apparatus and method for creating a personal enclosure, and more specifically a personal enclosure with an insert.

BACKGROUND

Outdoor athletic and entertainment events are very frequently observed live by players and an audience. In many outdoor venues the people attending do not have any form of shelter from the elements and environment. In these outdoor venues, spectators or players may have no choice but to stand in the rain, sleet, snow, or wind if precipitation occurs during the event they are attending or, in the warmer summer months, be exposed to intense sunlight and pests such as bugs and other insects in the surrounding environment.

One method used to combat undesirable weather conditions during an outdoor event is to use an umbrella to provide limited shelter from any precipitation that is descending from the skies. Umbrellas, however, only provide minimal shelter, and leave a majority of the user's body exposed to the elements. Alternatively a typical camping tent can provide better shelter from the elements, but not allow the user to adequately observe the live event or interact with surrounding event-goers. These conventional camping tents also can be difficult to assemble and disassemble. With regard to unwanted exposure to intense sunlight or bugs and other insects, a spectator or player can apply sun block or bug spray or wear clothing such as long sleeve shirts and pants to obstruct the sunlight and bugs. However, applying sun block and/or bug spray or wearing fully covering clothing can be inconvenient and lead to an unpleasant experience.

Personal attendance of outdoor events has proven to be desirable in spite of adverse conditions and inconvenient solutions described above. Accordingly, there is a need for an enclosure that allows unobstructed views of the event, full protection from the elements and environment, and an opportunity to interact with fellow event attendees.

SUMMARY

An embodiment of the present disclosure includes a collapsible personal enclosure and an insert for accommodating a user. The personal enclosure includes a body formed by a plurality of walls including at least a front wall, a back wall, a first side wall, a second side wall, a top wall, and a bottom wall coupled to one another to form an interior, the interior configured to be occupied by the user. The personal enclosure includes a plurality of deformable frame members, wherein each of the front wall, the back wall, the first side wall, and the second side wall includes at least one of the plurality of deformable frame members. Optionally, the personal enclosure can include a window defined in one of the front wall, back wall, first side wall and second side wall, wherein the window is selectively engageable with the respective wall such that the window is disposable between an open and closed position. Optionally, the personal enclosure can include a door defined in one of the front wall, back wall, first side wall, and second side wall, wherein the door is selectively engageable with the respective wall such that the door is disposable between an open and closed position. The front wall defines a first plane and the back wall defines a second plane, the first plane and second plane are substantially parallel to one another. The body of the personal enclosure is collapsible between an upright configuration that defines the interior and a collapsible configuration. The insert is collapsible and includes a body formed by a plurality of walls including at least a front wall, a back wall, a first side wall, and a second side wall coupled to one another to form an interior that is unbounded on the top and bottom. The insert is configured to be placed within the personal enclosure and configured to be occupied by the user. The insert includes a plurality of deformable frame members, wherein each of the front wall, the back wall, the first side wall, and the second side wall includes at least one of the plurality of deformable frame members and a door defined in one of the front wall, back wall, first side wall, or second side wall, wherein the door is alignable with a door of the personal enclosure and selectively engageable with the respective wall such that the door is disposable between an open and closed position. The front wall defines a first plane and the back wall defines a second plane, the first plane and second plane are substantially parallel to one another. The insert is constructed of a material that allows air to pass through the walls of the insert. In one example, the material is a fine mesh that allows air to pass through the walls, but prevents bugs and other insects from passing through the walls. The insert is sized to generally fill the entire interior space of the personal enclosure. Both the personal enclosure and the insert are collapsible between an upright configuration and a collapsible configuration.

In one example of this embodiment, the personal enclosure can include doors, windows, and/or vents in the first side wall, second side wall, and back wall. In such embodiments, the doors, windows, and/or vents are selectively engageable with the walls, respectively. In another example, at least one of the doors is in a side wall and is foldable in a direction towards the back wall when selectively disengaged from the respective wall. In a another example, wherein the window and/or vent is defined in an upper half or lower half of the respective wall of the personal enclosure, and the door is defined in both the upper and lower halves of the respective wall. In another example of the personal enclosure, wherein the first side wall defines a third plane and the second side wall defines a fourth plane, the third plane and fourth plane being substantially parallel to one another, and the first and second planes being substantially perpendicular to the third and fourth planes. In another example of the insert, wherein the first side wall defines a third plane and the second side wall defines a fourth plane, the third plane and fourth plane being substantially parallel to one another, and the first and second planes being substantially perpendicular to the third and fourth planes.

In another example, a removable roof is formed of water impermeable and sun blocking material and including at least one connector, the at least one connector being removably coupled to the body of the personal enclosure. In another example, at least one strap is coupled to the body of the personal enclosure, the at least one strap defining an opening for receiving the at least one connector of the roof. In another example, a second window is defined in and selectively engageable with one of the front, back, first side and second side walls of the personal enclosure, the second window having a height and width which are smaller than a height and width of the first window. In another example, the second window of the personal enclosure is defined in the same wall as the first window. In another example, the second window is defined in the same wall as the door. In another example, wherein the door comprises a first door and a second door, the first door being defined in and selectively engaged with the front wall and the second door being defined in and selectively engaged with the back wall; wherein, the first door is spaced by a first distance from the bottom wall, and the second door is spaced by a second distance from the bottom wall, where the second distance is less than the first distance.

In another example of the insert, the insert is arranged to be secured to the personal enclosure once positioned within the personal enclosure. Once the insert is positioned within the personal enclosure, the doors, windows, and/or vents of the personal enclosure can be opened to allow air to pass through the personal enclosure, while the insert prevents bugs and other insects from entering the insert. Either an opaque top wall or roof can block sunlight so that the occupant of the personal enclosure can avoid direct exposure to the sun. The arrangement of the personal enclosure having its doors, windows, and/or vents open and the insert positioned within the personal enclosure prevents the personal exposure from becoming overheated.

Another embodiment of the present disclosure includes a collapsible personal enclosure and an insert for accommodating a user. The personal enclosure includes a body formed by a plurality of walls including at least a front wall, a back wall, a first side wall, a second side wall, a top wall, and a bottom wall coupled to one another to form an interior, the interior configured to be occupied by the user. The personal enclosure includes a plurality of deformable frame members, wherein each of the front wall, the back wall, the first side wall, and the second side wall includes at least one of the plurality of deformable frame members. Optionally the personal enclosure can include a window defined in one of the front wall, back wall, first side wall and second side wall, wherein the window is selectively engageable with the respective wall such that the window is disposable between an open and closed position. Optionally, the personal enclosure can include a door defined in one of the front wall, back wall, first side wall, and second side wall, wherein the door is selectively engageable with the respective wall such that the door is disposable between an open and closed position. The front wall defines a first plane and the back wall defines a second plane, the first plane and second plane are not parallel, but positioned at an including angle to one another, where the distance between the first plane and second plane is greater at the bottom of the planes than at the top of the planes. The body of the personal enclosure is collapsible between an upright configuration that defines the interior and a collapsible configuration. The insert is collapsible and includes a body formed by a plurality of walls including at least a front wall, a back wall, a first side wall, and a second side wall coupled to one another to form an interior that is unbounded on the top and bottom. The insert is configured to be placed within the personal enclosure and configured to be occupied by the user. The insert includes a plurality of deformable frame members, wherein each of the front wall, the back wall, the first side wall, and the second side wall includes at least one of the plurality of deformable frame members and a door defined in one of the front wall, back wall, first side wall, or second side wall, wherein the door is alignable with a door of the personal enclosure and selectively engageable with the respective wall such that the door is disposable between an open and closed position. The front wall defines a first plane and the back wall defines a second plane, the first plane and second plane are not parallel, but positioned at an including angle to one another, where the distance between the first plane and second plane is greater at the bottom of the planes than at the top of the planes. The insert is constructed of a material that allows air to pass through the walls of the insert. In one example, the material is a fine mesh that allows air to pass through the walls, but prevents bugs and other insects from passing through the walls. The insert is sized to generally fill the entire interior space of personal enclosure. Both the personal enclosure and the insert are collapsible between an upright configuration and a collapsible configuration.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art can appreciate and understand the principles and practices of the present disclosure.

Figure 1:
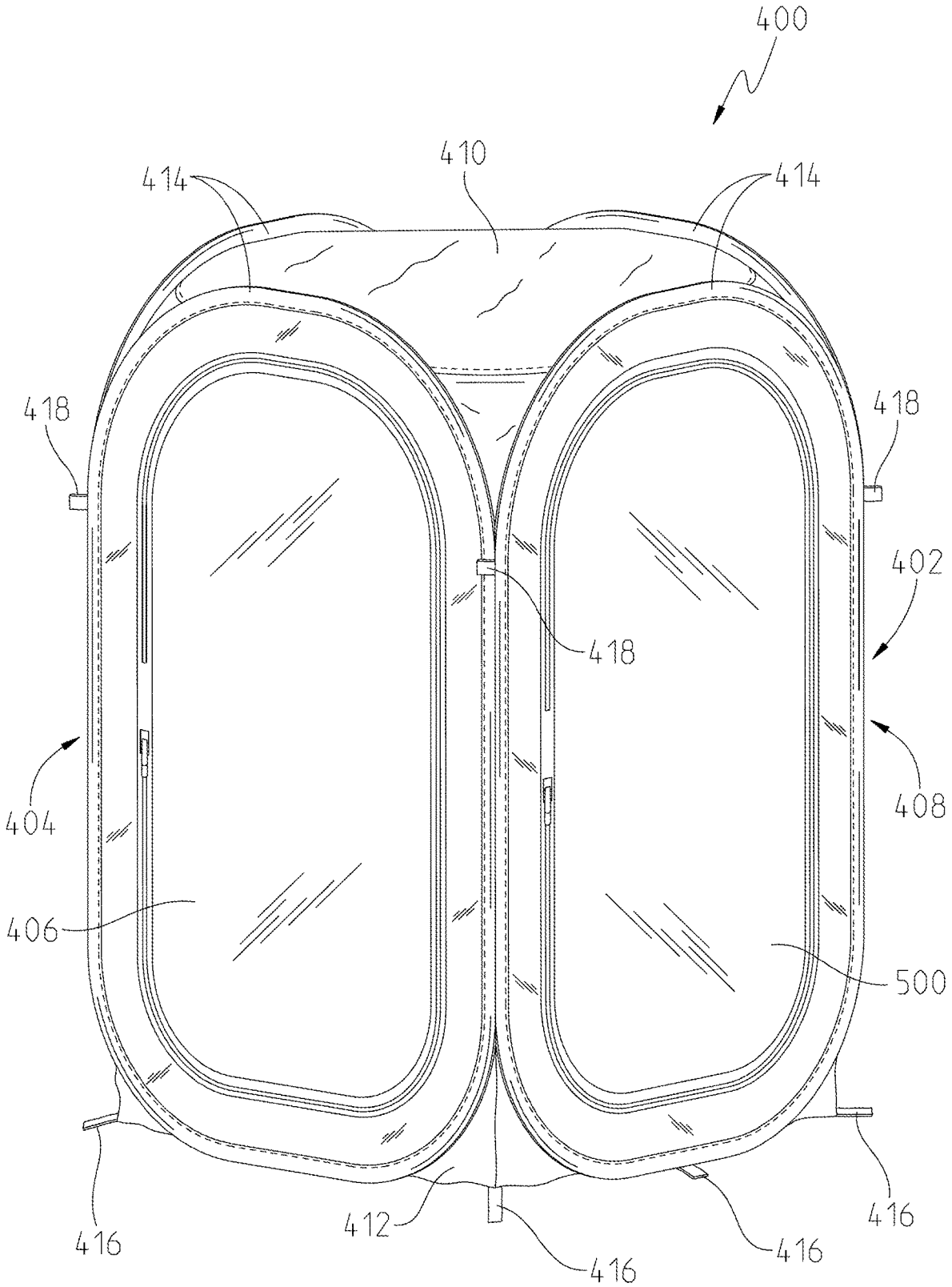
FIG. 1 is a perspective view of one embodiment of a personal enclosure.

Referring to FIG. 1, a collapsible personal enclosure 400, also referred to as a pod, is schematically illustrated. The pod 400 can be a synthetic, cloth, or cloth-like material that is disposed around or between at least one frame element 414 to define an inner cavity. The pod 400 can define at least one door 500 that is positionable between a closed position (as seen in FIG. 1) and an open position. The door 500 can be held in the fully closed position by a plurality of fasteners. In one non-exclusive embodiment, a zipper can be used to uncouple portions of the door 500 from the pod 400. Alternatively, magnets, buttons, a hook and loop system (for example, products sold under the trademark Velcro®), or any other common coupling means as is known in the art could be used to perform the coupling feature.

The material disposed between the frame element 414 can be an impermeable material that can substantially encapsulate the inner cavity when doors, windows, and vents are in a closed position. Further, the material can be any number of colors or can be substantially clear. A person having skill in the relevant art understands the advantages of utilizing a clear material so that the surrounding area can be observed by anything located in the inner cavity. Alternatively any combination of colored or clear material can be used. In one embodiment, a substantial portion of the pod can be formed by a camouflage material while only a small portion of the material is clear. In FIG. 1, and in many of the other embodiments disclosed herein, broken lines shown in the illustrated embodiments can represent a stitch line or the like of material used for making the enclosure or stitching various sides to one another.

The door 500 can consist of a majority of a side of the pod 400. The door 500 can be substantially uncoupled from the side in the open position. In the open position, the door 500 can be rolled, folded, or the like to become disposed along one side of the door opening. Once removed from the door opening, the door 500 can be held in its open position by a removable coupler, such as hook and loop system, snap, clip, latch, one or more ties, buttons, magnetic members, or the like. In the open position, the door 500 can be held substantially away from the door opening. In a different embodiment, the door 500 can be completely uncoupled and removed from the pod.

Figure 3:
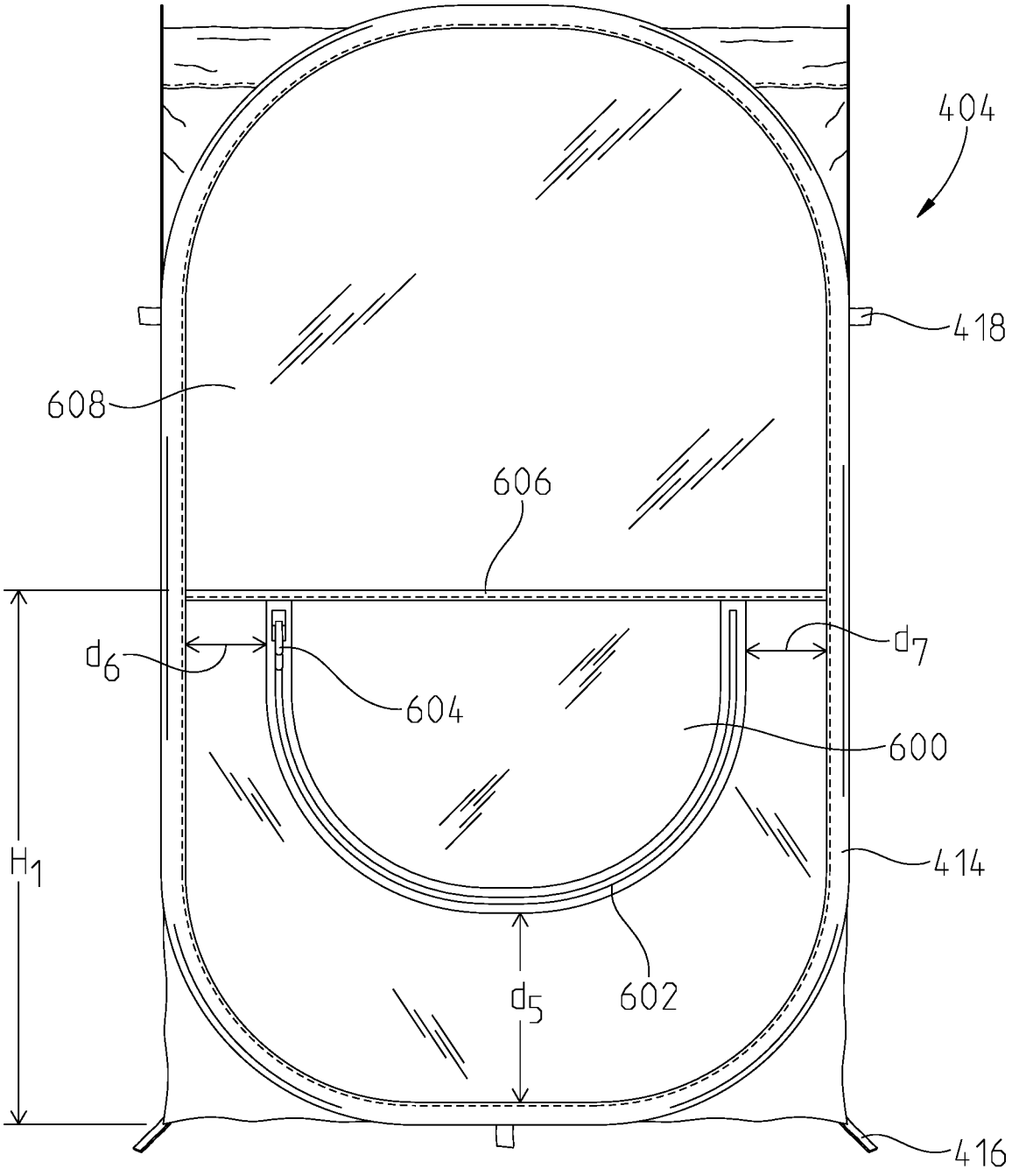
FIG. 3 is a rear view of the personal enclosure of FIG. 1.

Each window (as illustrated in FIGS. 9 and 12-14 for example) can similarly be disposed along a portion of a side of a pod. In the open position the window can also have an open, compact position that leaves a portion thereof substantially unobstructed. The window can be held in the open, compact position by a removable coupler, such as hook and loop system, snap, clip, latch, one or more tie, one or more button, one or more magnetic member, or the like. Alternatively, the window can be entirely uncoupled and removed from the pod in its open position. A vent (as illustrated in FIG. 3), can also be disposed in a wall.

In one embodiment, the pod has at least two doors disposed on sides that are substantially opposite from one another. Such positioning the two doors can allow breezes to pass though the pod to cool the pod when temperatures are high. The skilled artisan will understand that a door can be located on any particular side of the pod depending on the needs of the user. In one non-limiting example, a removable door can be disposed on each side of the pod. Accordingly, this disclosure is not limited to any one particular door configuration.

It will be understood that when the weather is inclement, i.e., rain, sleet, snow, or generally cold temperatures, it can be advantageous to close all doors, windows, and vents of the pod to keep the occupant warm and dry. However, on warm and sunny days, it can be advantageous to open all doors, windows, and vents to allow the free flow of air through the pod to cool interior of the pod. Under such circumstances, an insert (as illustrated in FIGS. 16-38) can be positioned within the enclosure. The insert can be made of a material, such as a fine mesh, that allows the free flow of air through the pod, but blocks bugs and other insects. The insert can be arranged to generally fill the interior space of the pod. The insert can include a door that aligns with one of the doors of the pod to facilitate entering and exiting the insert and pod. The door can be arranged to be positionable between a closed position and an open position. The door can be held in the fully closed position by a plurality of fasteners. In one non-exclusive embodiment, a zipper can be used to uncouple portions of the door 500 from the pod 400. Alternatively, magnets, buttons, hook and loop system, or any other common coupling means as is known in the art could be used to perform the coupling feature. It will be understood that such an arrangement provides for the insert to be fully enclosed so that the occupant is protected from the environment, i.e., bugs and other insects, while the pod is arranged to allow the maximum flow of air through the pod. When the pod has an opaque top wall or an opaque roof covering the pod, the occupant is further protected from direct exposure to sunlight.

The insert can be coupled to the pod using any number of coupling mechanisms. For example, the insert can be coupled to the pod using at least one button, zipper, hook and loop system, ties, straps, snaps, or any other similar coupling means. Accordingly, this disclosure is not limited to any one configuration.

Figure 6:
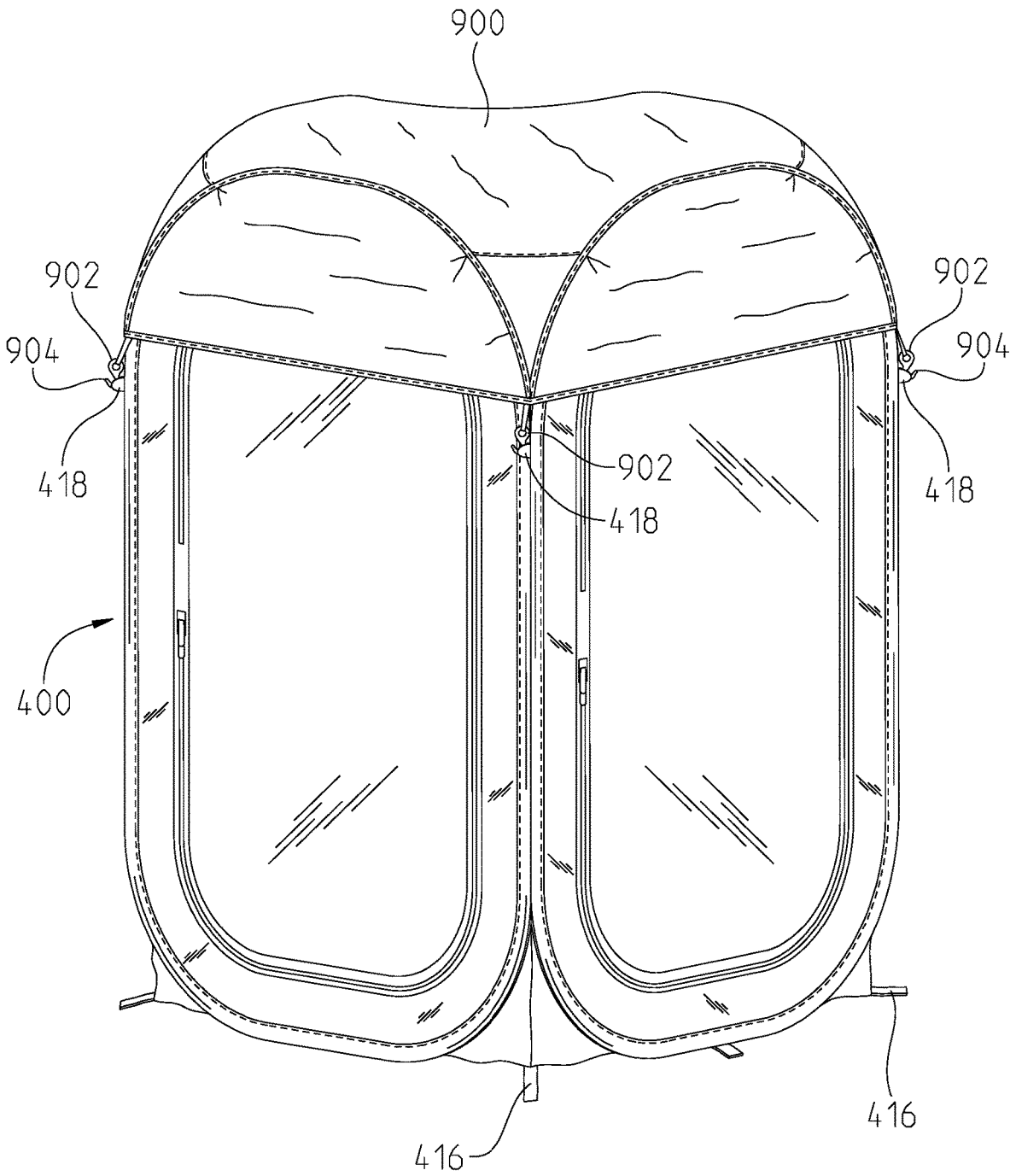
FIG. 6 is a perspective view of a second embodiment of a personal enclosure.

Yet another aspect of the present disclosure is a removable roof 900 (as illustrated in FIG. 6). The roof 900 can be positionable above the pod 400 and is adapted to couple to an upper portion of the pod 400. In one embodiment, the roof 900 can be coupled to frame of the pod. The roof 900 can be coupled to the frame using a plurality of coupling means such as, for example, buttons, zippers, hook and loop system, ties, hooks or any other coupling means. In one embodiment, the roof 900 can provide an additional water and sun barrier (besides a top side of each pod) along the top portion of the pod.

The pod can also contain at least one anchoring or latching means 416 to anchor the pod 400 to the underlying ground surface. The anchoring means 416 can be an extension of the material from the frame that can become disposed along the underlying surface. Further, in one embodiment, the anchoring means 416 can terminate at a loop. The loop can therefore provide a location to drive a stake or other securing means through the anchoring means and into the underlying ground surface to hold or maintain the pod from moving. In one embodiment, there can be an anchoring means at each bottom corner of the pod.

The frame can be composed of a material having sufficient elastic properties to allow the frame to be manipulated by a user into multiple configurations yet strong enough to maintain the material in a position defining the inner cavity. Further, the frame and material can be configured to allow the user to manipulate a pod to become disposed in a substantially flat or collapsed configuration (not shown). In the collapsed configuration, a user can easily transport or store the pod. Similarly, the frame of the insert can be composed of a material having sufficient elastic properties to allow the frame to be manipulated by a user into multiple configurations yet strong enough to maintain the material in a position defining an inner cavity. Further, the frame and material can be configured to allow the user to manipulate an insert to become disposed in a substantially flat or collapsed configuration (not shown). In the collapsed configuration, a user can easily transport or store the insert.

In one embodiment, the user can have a pod and insert in their collapsed configuration. The user can manipulate the frame and the material of the pod so that it becomes assembled in its upright position that defines the inner cavity. The user can then place the collapsed insert into the inner cavity of the pod, and the user can manipulate the frame and the material of the inset so that it becomes assembled in its upright position within the inner cavity of the pod. The user can further align the door of the insert with a door of the pod to facilitate a user's entrance and exit from the insert and pod.

The aforementioned pods and inserts can include substantially parallel planar sides, or alternatively can have tapered planar sides, where the distance between the sides is greater at the bottom than at the top. Tapered arrangements are illustrated in FIGS. 7-11, for example.

Referring again to FIG. 1 to further describe the pod, the pod 400 can include a plurality of sides including a front wall 402, a back wall 404, a first side wall 406, and a second side wall 408. Each wall can be formed of a water impermeable material to prevent water from leaking or getting into the interior of the enclosure. Each wall can also include a frame structure 414 that provides stability to the enclosure and maintains it in its upright position. Each frame structure 414, however, can be flexible, bendable, pliable, etc. such that the enclosure can be folded or collapsed into a collapsed or storage position. This allows the enclosure to be easily transported or stored.

The enclosure 400 can also include a top 410 and a bottom 412. The top 410 can be formed of a multi-layer material to further inhibit water from leaking into the interior of the pod and inhibiting the direct exposure to sunlight into the pod. As shown, the bottom 412 can include loops 416 through which a stake or anchor can be driven through to hold the enclosure in place. As also shown, the enclosure 400 can include straps 418 at one or more sides or corners thereof. The straps 418 can define an opening for receiving a hook or connector of a roof structure. This allows the enclosure 400 to be coupled with one or more other enclosures to form a multi-enclosure assembly.

Figure 4:
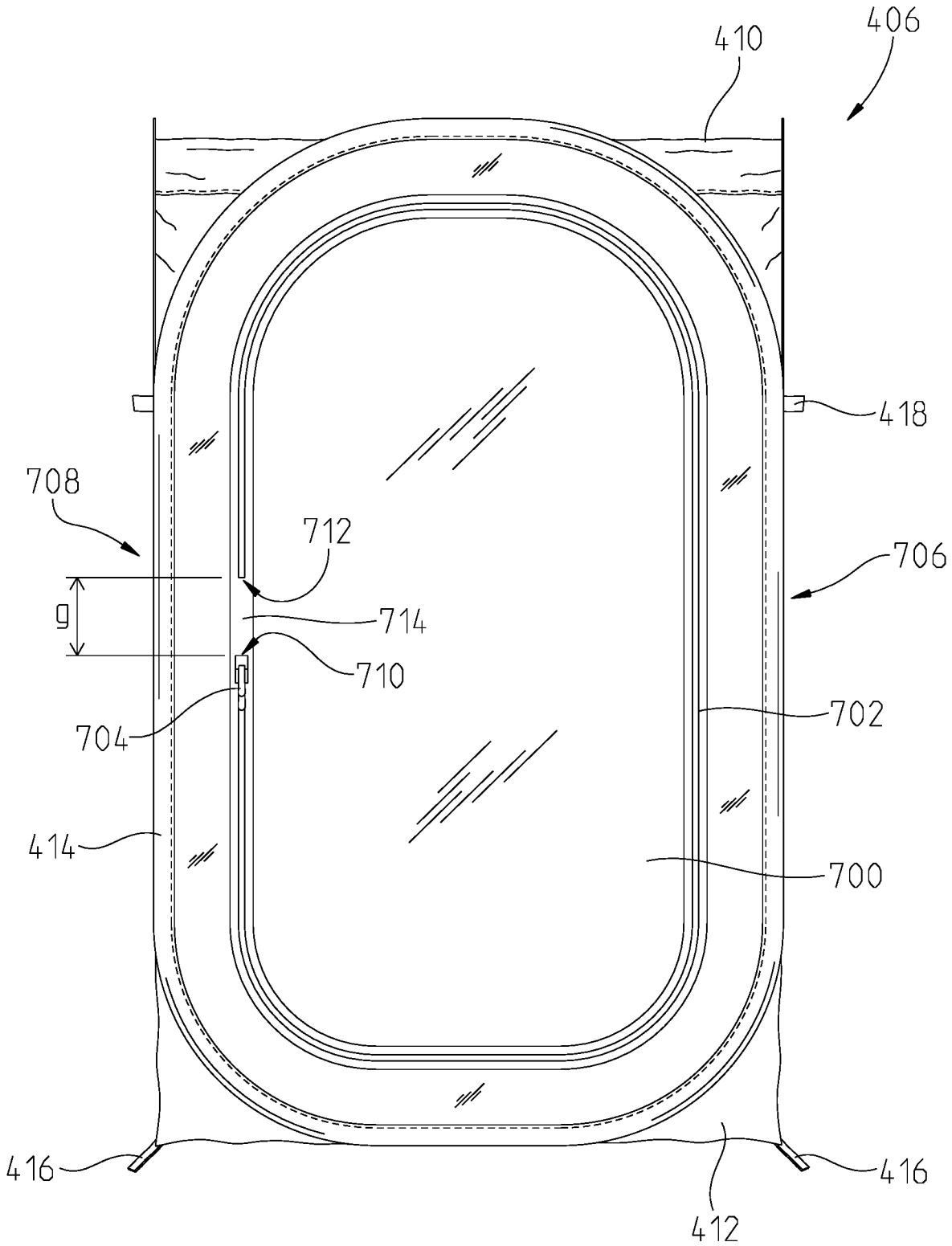
FIG. 4 is a first side view of the personal enclosure of FIG. 1.

In FIG. 4, each of the front wall 402, back wall 404, first side wall 406, and second side wall 408 are substantially upright and either parallel or perpendicular with the other walls. For example, the front wall 402 is substantially parallel to the back wall 404 and substantially perpendicular to the first and second side walls. In other words, each wall defines a plane, and each plane is either parallel or perpendicular to the other planes. Moreover, the front wall 402, back wall 404, first side wall 406, and second side wall 408 are substantially perpendicular to the top wall 410 and bottom wall 412.

As such, the top wall 410 and bottom wall 412 can include approximately the same dimensions as one another, and the front, back and side walls can each include approximately the same dimensions (e.g., height and width) as one another. For a person to occupy the interior of the enclosure 400, the height of the front, back and side walls can be appropriately sized to allow a user to either stand or sit in the interior. Moreover, the width of the front, back, and side walls can be sized to allow a chair (e.g., a folding chair, a lawn chair, a wheelchair, etc.) to fit comfortably in the interior. The dimensions and size of the interior of the enclosure 400 is also an appropriate consideration with other enclosures described herein.

Figure 2:
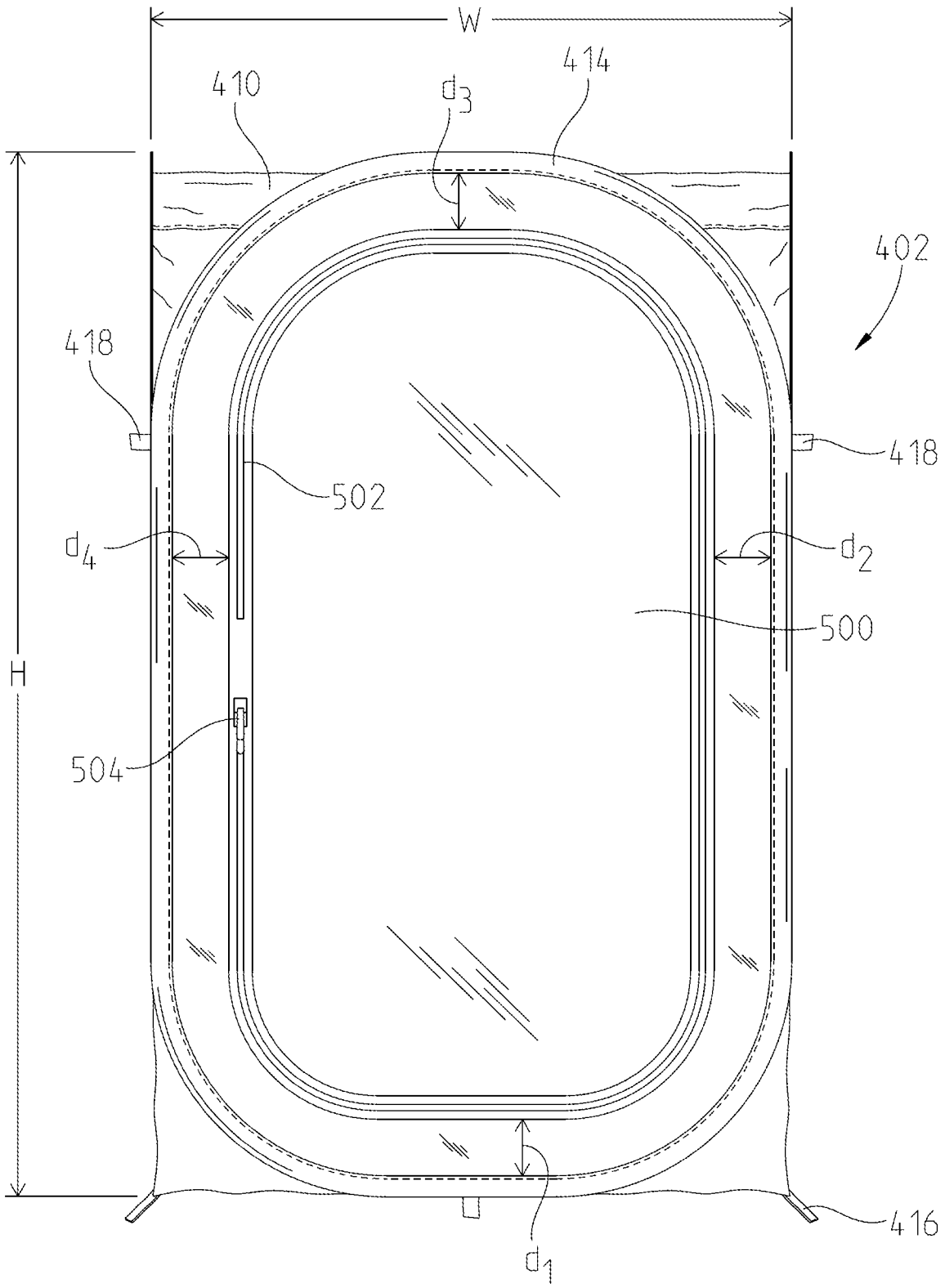
FIG. 2 is a front view of the personal enclosure of FIG. 1.

Referring to FIGS. 2-5, different walls of the enclosure 400 are shown in greater details. In FIG. 2, for example, the front wall 402 is shown with a door 500. The door 500 is shown occupying the majority of the front wall 402, and it can be opened or closed via a zipper 502. A zipper pull 504 can be provided for manipulating the zipper. As shown, the door 500 is spaced from each edge of the front wall 402 by a distance. For example, at the bottom of the front wall 402, a distance d1 separates the door 500 from the outer edge of the front wall 402. The door 500 is separated by distance d2 along the right side of FIG. 2, by distance d3 at the top, and by distance d4 along the left side. In one aspect, the distance between the door 500 and the outer edge of the front wall 402 can be the same. Alternatively, the distance can differ at each edge. As shown in FIG. 2, the zipper pull 504 can be pulled down and around the zipper 502 to open the door 500. In doing so, a hinge is formed on the left side of the front wall 402 as shown in FIG. 2 by which the door 500 can be pivoted or otherwise moved away from the front wall 402 to allow ingress and egress through the door opening.

In FIG. 3, the back wall 404 of the enclosure is shown. Here, the back wall 404 includes a window or vent 600 formed in a lower portion thereof. In particular, the back wall 404 can have an overall height as shown in FIG. 3, and a seam 606 is defined at a height H1 from the bottom edge of the wall. The upper portion of the back wall 404 includes a cover 608.

The window 600 can be opened via a zipper 602. A zipper pull 604 can be used to manipulate the zipper and open the window 600. The window 600 has a semicircular shape as shown in FIG. 3. A bottom edge of the window 600 is disposed at a distance d5 from the bottom edge of the back wall 404. The window is spaced a distance d6 from a left edge of the back wall 404 and by a distance d7 from a right edge thereof. These distances can be the same in one embodiment, whereas in other embodiments these distances can differ. In FIG. 3, the side distances d6 and d7 can be less than the bottom distance d5. In other embodiments, the entire bottom half or top half of the back wall 404 can form a window such that each distance is approximately zero. Other window sizes are contemplated in this disclosure.

Referring to FIG. 4, a door 700 is defined in the first side wall 406. The door 700 can be removably coupled to the first side wall 406 by a zipper 702. A zipper pull 704 can be used to manipulate the zipper 702 so that the door can be configured in an open position, a closed position, or any position therebetween. As shown, the zipper 702 has a first end 710 and a second end 712. The zipper pull 704 is disposed at the first end 710 when the door 700 is in the closed position, whereas the zipper pull 704 can be disposed at the second end 712 when the door 700 is in the open position.

In FIG. 4, there is a non-zipper area 714 defined in the first side wall 406 between the first zipper end 710 and the second zipper end 712. This area 714 can be defined by a space or gap "g" as shown in FIG. 4. As also shown in FIG. 4, the non-zipper area 714 is located on the first side wall 406 at a location towards a back side 708 of the enclosure 400. For sake of clarity, the back wall 404 is located towards the back side 708 of the enclosure 400, and the front wall 402 is located towards a front side 706 thereof. In this embodiment, the non-zipper area 714 can function as a door hinge. As the zipper pull 704 manipulates the zipper 702 such that the door 700 is fully opened, i.e., the zipper pull 704 is located at the second zipper end 712, the door 700 can be pulled or folded towards the back side 708 of the enclosure. A coupling mechanism such as hook and loop system, a snap, latch, hook, or other means can be used for coupling the door 700 to the back wall 404 or at least to a back side 708 of the enclosure 400. Thus, if a user is occupying the pod 400 and the door 700 is opened, the door 700 is disposed on the back side 708 of the pod 400 rather than the front side 706 which can interfere or obstruct the view of the user while inside the enclosure. This of course can be reversed in other embodiments where the door is capable of being folded or disposed on the front side 706 of the enclosure. In yet a further embodiment, it can be possible to completely remove the door 700 from the first side wall 406. In an alternative embodiment, the door 700 can be removably coupled to the first side wall 406 by a coupling means other than a zipper. Other selectively engageable mechanisms such as snaps, clips, latches, hooks, and the like can be used for selectively coupling the door to the wall.

Figure 5:
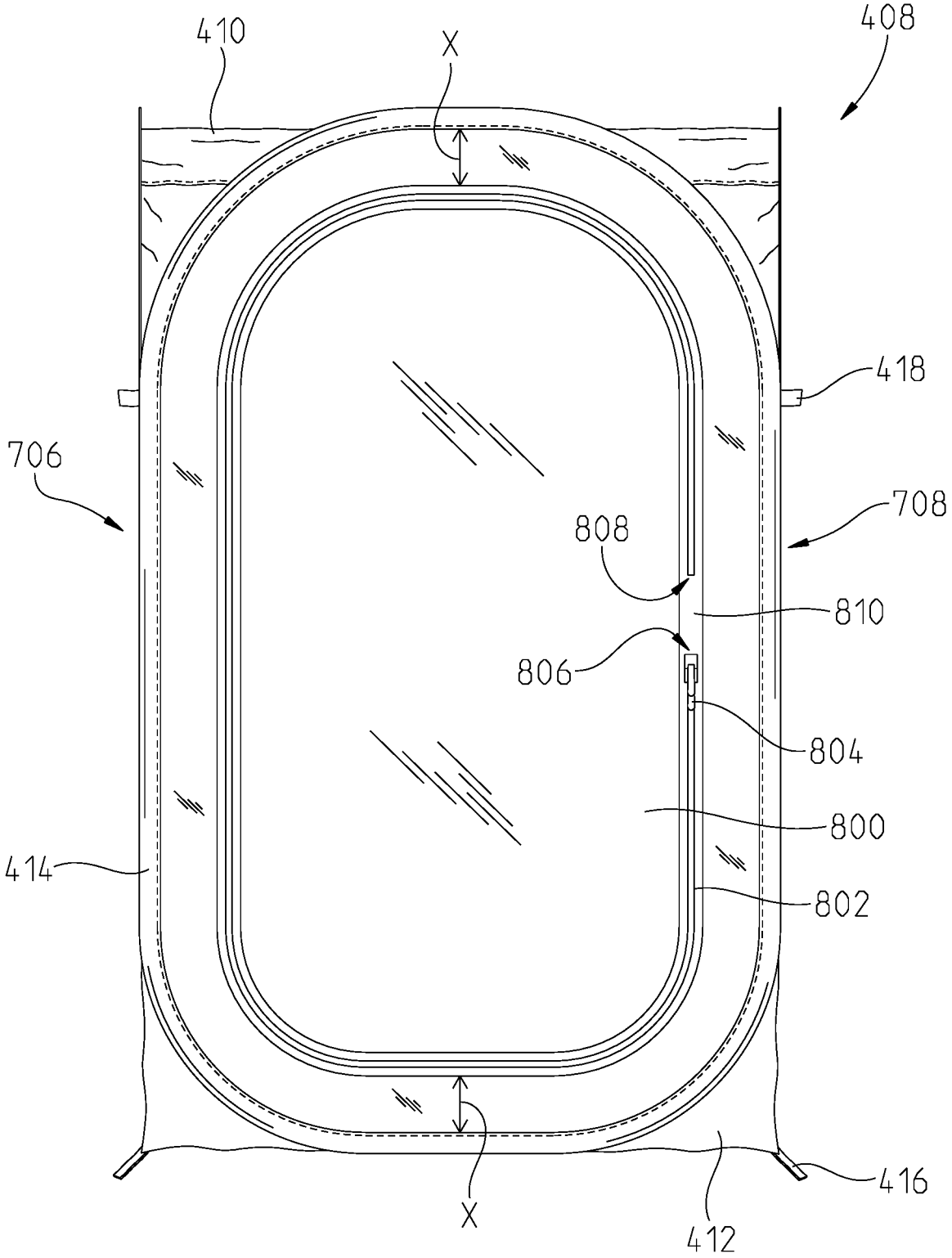
FIG. 5 is a second side view of the personal enclosure of FIG. 1.

In FIG. 5, the second side wall 408 is shown. The teachings of FIG. 4 can apply to FIG. 5 as well. Here, a second door 800 is formed in the second side wall 408, where the door 800 occupies a substantial portion of the wall. For example, the door 800 can be spaced by a distance "x" from the outer edge of the second side wall 408. In other embodiments, the distance can differ between the door and outer edge of the second side wall. In one non-limiting example, the distance "x" can be between 2-10 inches. In a second non-limiting example, the distance "x" can be less than 20 inches. In a further non-limiting example, the distance "x" can be approximately zero inches. The distance "x" can be any value based on the desired size of the door 800 with respect to the side wall.

Like FIG. 4, the door 800 can be selectively engaged with the second side wall 408 via a zipper 802. The zipper 802 can be manipulated by a zipper pull 804, as shown in FIG. 5. The zipper 802 can include a first zipper end 806 and a second zipper 808, where a non-zipper area 810 is defined therebetween so that the door 800 can be disposed towards the back side 708 of the enclosure 400. In this way, the non-zipper area 810 can function similar to a hinge.

In an alternative embodiment shown in FIG. 6, the pod 400 is shown having a removably coupled roof structure 900. The roof structure 900 is sized to fit over the top wall 410 of the enclosure 400 and at least an upper portion of the front wall 402, back wall 404, first side wall 406, and second side wall 408. The roof structure 900 can be formed of a nylon material, although it can be made of any elastic or semi-elastic material that allows it to stretch. While being elastic is desirable in at least one embodiment, in other embodiments the roof structure 900 can be non-elastic but sized to fit properly over the enclosure 400.

The roof structure 900 can include one or more connectors 902. Each connector 902 can include a hook end 904 as shown in FIG. 6. Here, each connector 902 can engage or couple to one of the straps 418 on the enclosure 400 for coupling the roof structure 900 thereto. The hook end 904 can fit through an opening formed in the strap 418 to complete the coupling step. When coupled, the roof structure 900 can provide additional protection from rain, water, snow, wind, insects, direct sunlight, and the like. Moreover, the roof structure 900 can be used for coupling two or more enclosures to one another to form a multi-enclosure assembly.

Figure 7:
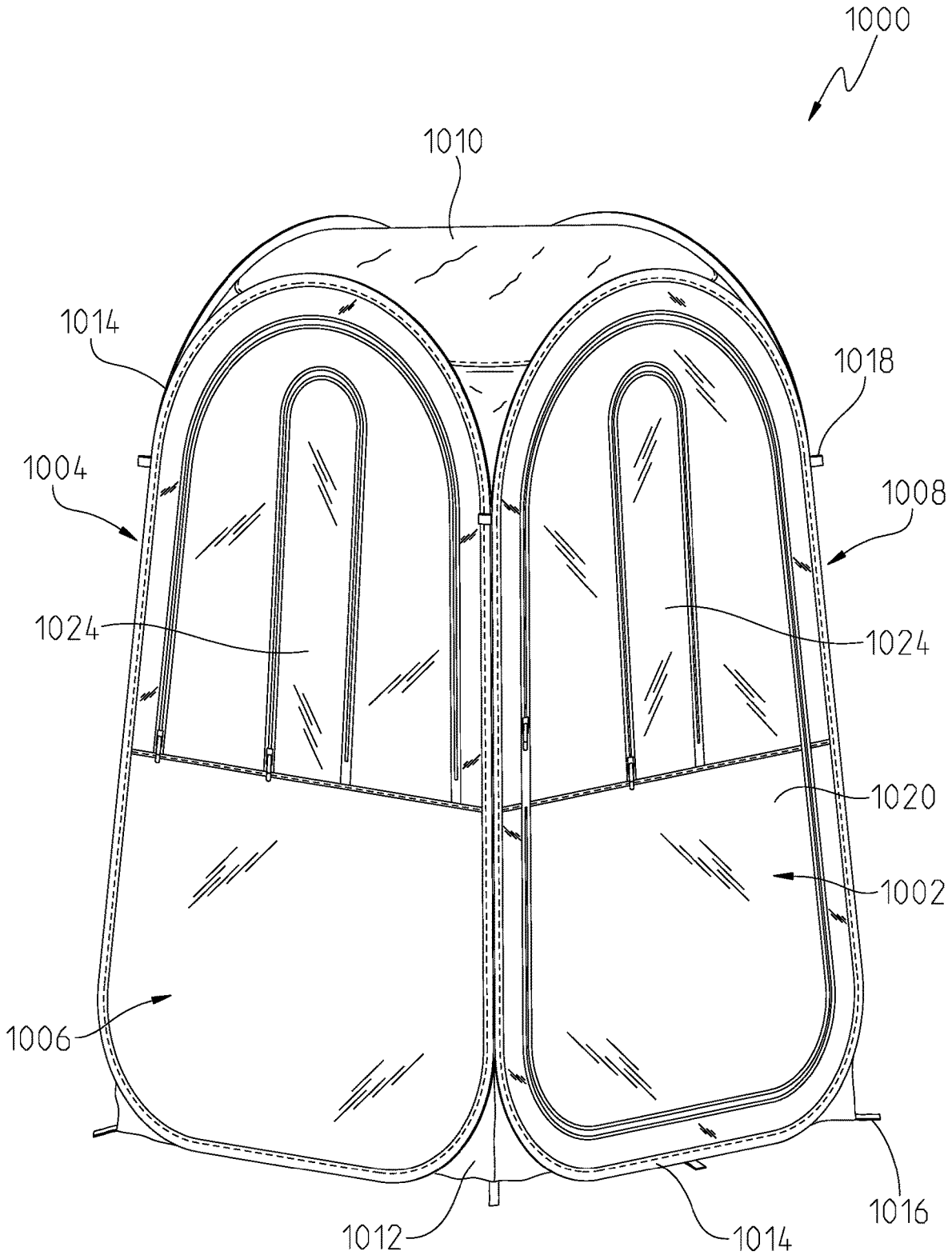
FIG. 7 is a perspective view of a third embodiment of a personal enclosure.

Referring to FIG. 7, another embodiment of an enclosure 1000 is shown. This enclosure 1000 is a tapered enclosure whereby the base of the enclosure is greater than its top. The enclosure 1000 can include a front wall 1002, a back wall 1004, a first side wall 1006, a second side wall 1008, a top wall 1010, and a bottom wall 1012. With a tapered design, the bottom wall 1012 is larger than the top wall 1010. The front, back and side walls can be formed by individual frame members 1014. Each frame member 1014 can have a circular, oval, or egg-like shape. This disclosure, however, is not limited to these shapes and the frame member 1014 can include rectangular, triangular, square, pentagon, hexagon, octagon, or any other type shape.

In this illustrated embodiment, the front, back and side walls are shown as being substantially transparent. This disclosure is not limited to color, size, shape or tint of the different walls. In some embodiments, each wall can be transparent. In other embodiments, each wall can be semi-transparent. In yet other embodiments, each wall can be opaque or non-transparent. In yet further embodiments, the walls can be a combination of transparent, semi-transparent, and non-transparent. For example, the upper back cover can be a solid, non-transparent material whereas the window can be transparent. Each embodiment described in this disclosure can have any combination of transparency, and a user can selectively purchase a type of enclosure based on his or her own desire.

Returning to the illustrated embodiment of FIG. 7 the enclosure 1000 can also include anchor straps or loops 1016 and roof-connecting straps 1018 similar to those previously described. In the front wall 1002, a door 1020 can be formed. The door 1020 can be selectively engaged to the front wall 1002 via a zipper or any other coupling means. The door 1020 can occupy a substantial portion of the front wall 1002, although this is not necessary in all embodiments. Rather, in some embodiments, the door 1020 can be sized appropriately for intended use. For example, an enclosure designed for children can have a smaller door than the one shown in FIG. 10.

Figure 8:
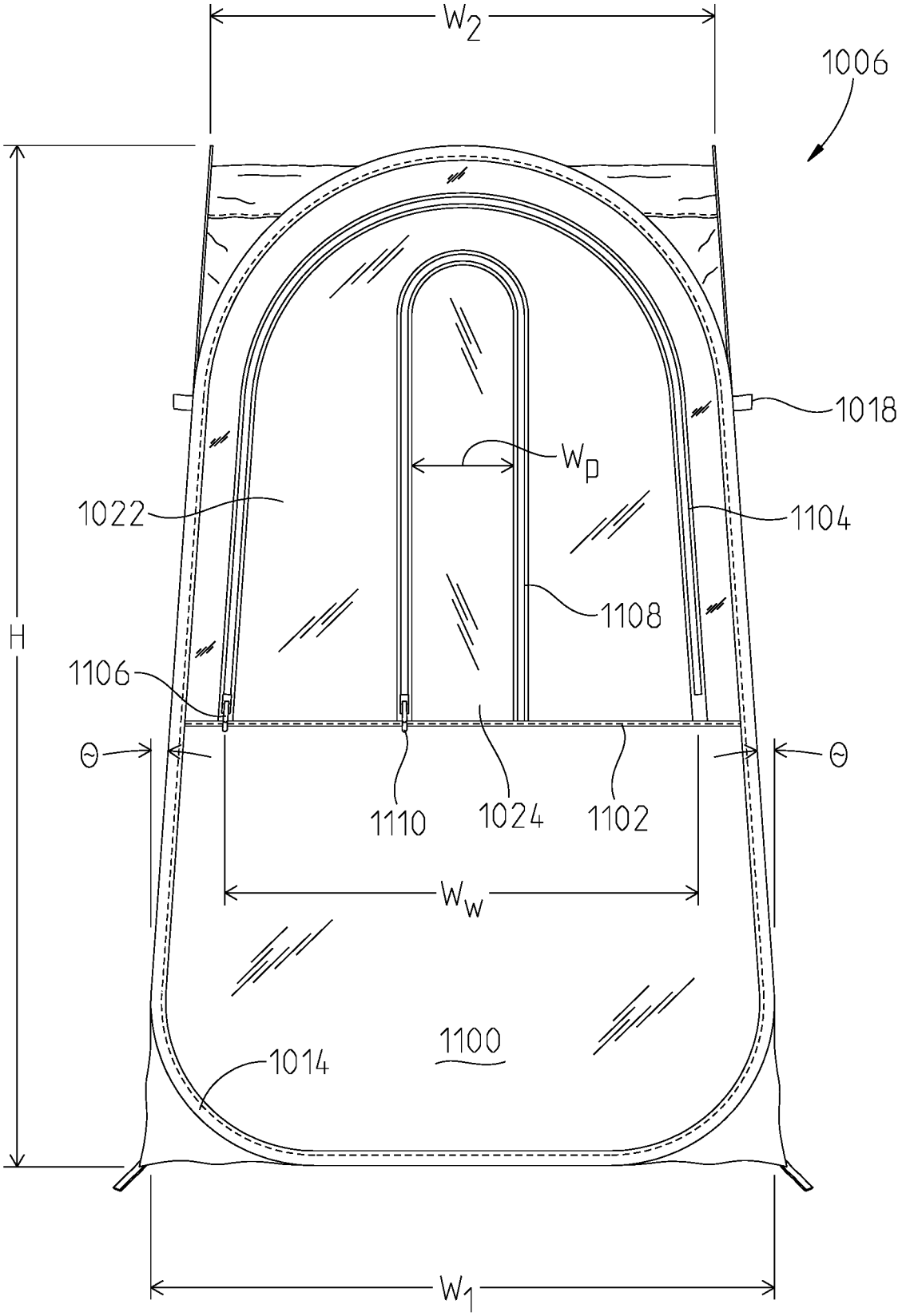
FIG. 8 is a side view of the personal enclosure of FIG. 7.
Figure 11:
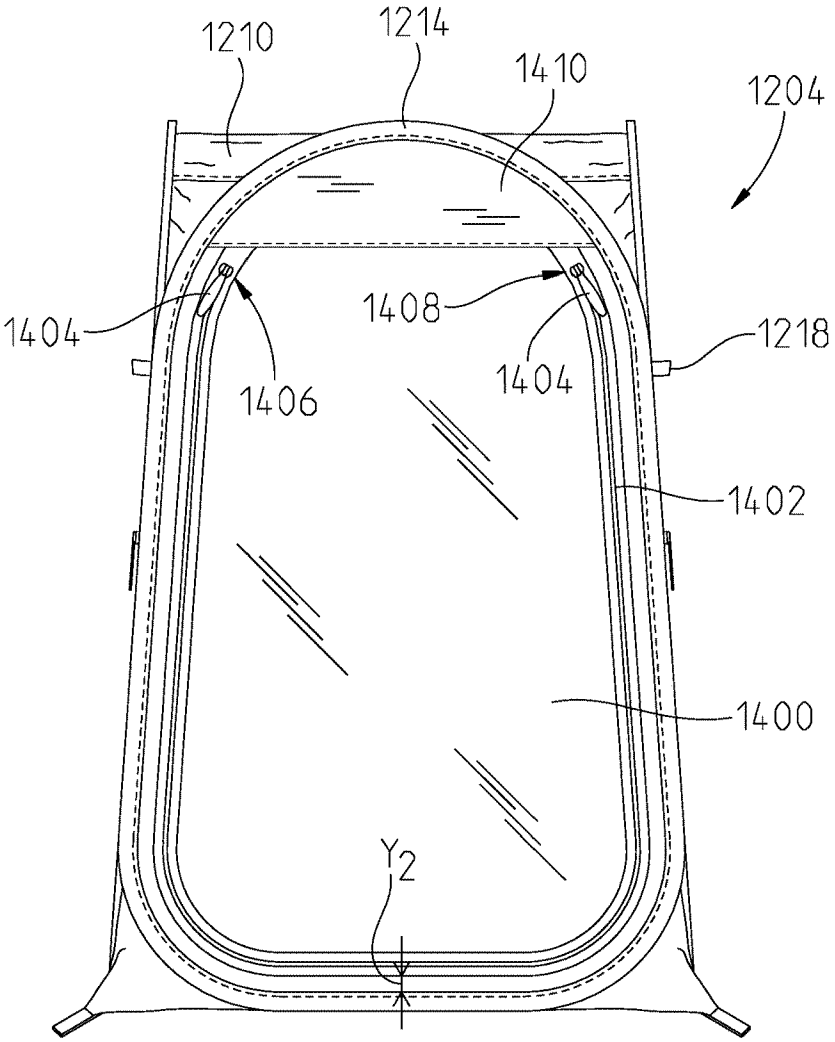
FIG. 11 is a rear view of the personal enclosure of FIG. 9.

As shown in FIG. 8, a window 1022 can be formed in the back wall 1004, first side wall 1006, or second side wall 1008. The window 1022 can be selectively coupled to the respective wall via a zipper 1104 (FIG. 11) or any other coupling means. A zipper pull 1106 can be used to selectively open or close the window 1022. In FIG. 11, a seam 1102 can separate the first side wall 1006 into a first or top portion and a second or bottom portion. The window 1022 can be formed in the first portion of the side wall, whereas a solid cover 1100 can be formed in the second portion.

Figure 10:
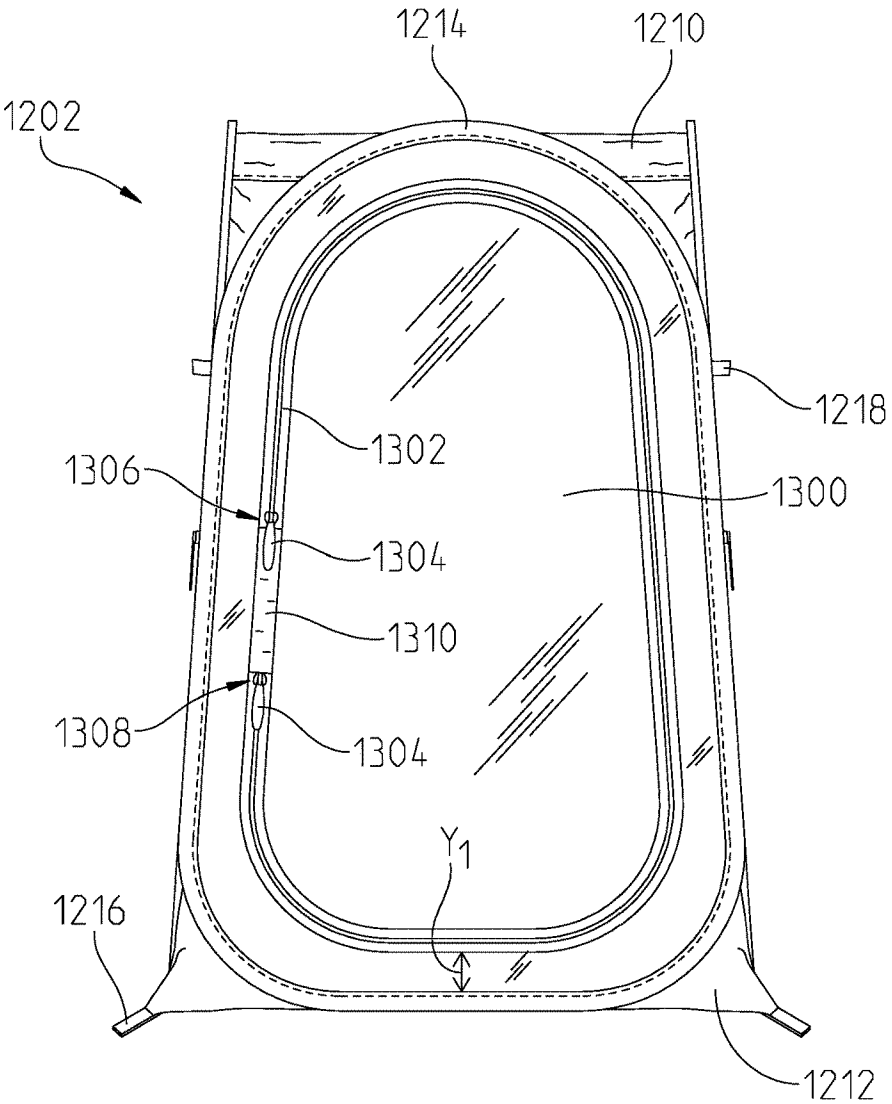
FIG. 10 is a front view of the personal enclosure of FIG. 9.

In the embodiment of FIGS. 7 and 8, the enclosure 1000 can include one or more secondary windows 1024. The secondary window 1024 can be used by a photographer, for example, for selectively opening so that a camera can extend therethrough and photograph or record an event (e.g., a youth sporting event). The secondary window 1024 can be formed in either the door 1020 or window 1022, as shown in FIG. 10. The secondary window 1024 can be selectively coupled to the front wall 1002 or door 1020, or the first side wall 1006 or window 1022, via a zipper 1108. A second zipper pull 1110 can be used to manipulate the zipper for selectively opening or closing the secondary window 1024.

Referring to FIG. 8, the secondary window 1024 is formed inside of the window 1022. The window 1022 can have a width Ww as shown in FIG. 11, whereas the secondary window 1024 can have a width of Wp. Here, Ww is greater than Wp. The secondary window 1024 can have a bottom edge that aligns with the seam 1102, and has a narrower opening when opened compared to the window 1022. In one non-limiting example, the secondary window can have a width that is approximately ¼ of the width of the window 1022. In another example, the secondary window 1024 can be sized with a width less than ½ of the window 1022. Other comparable sizes are possible with other embodiments.

As previously described, the enclosure 1000 is designed as a tapered enclosure. Here, each wall can have a base or bottom edge with a width W1 and a top edge with a width of W2. The side edge of each wall gets narrower as it moves from the bottom edge towards the top edge. The narrowing of the wall can correspond with an angle Θ as shown in FIG. 8. The angle Θ can be less than 30 degrees. In another embodiment, angle Θ can be less than 15 degrees. Yet further, the angle Θ can be between approximately 2 to 10 degrees.

Although the secondary window 1024 is shown and described with respect to the tapered design, it is understood that the secondary window 1024 can also be used with the upright or square design of the pod. Thus, the secondary window 1024 is like other features described herein such that it can be used with any of the different enclosures.

Figure 9:
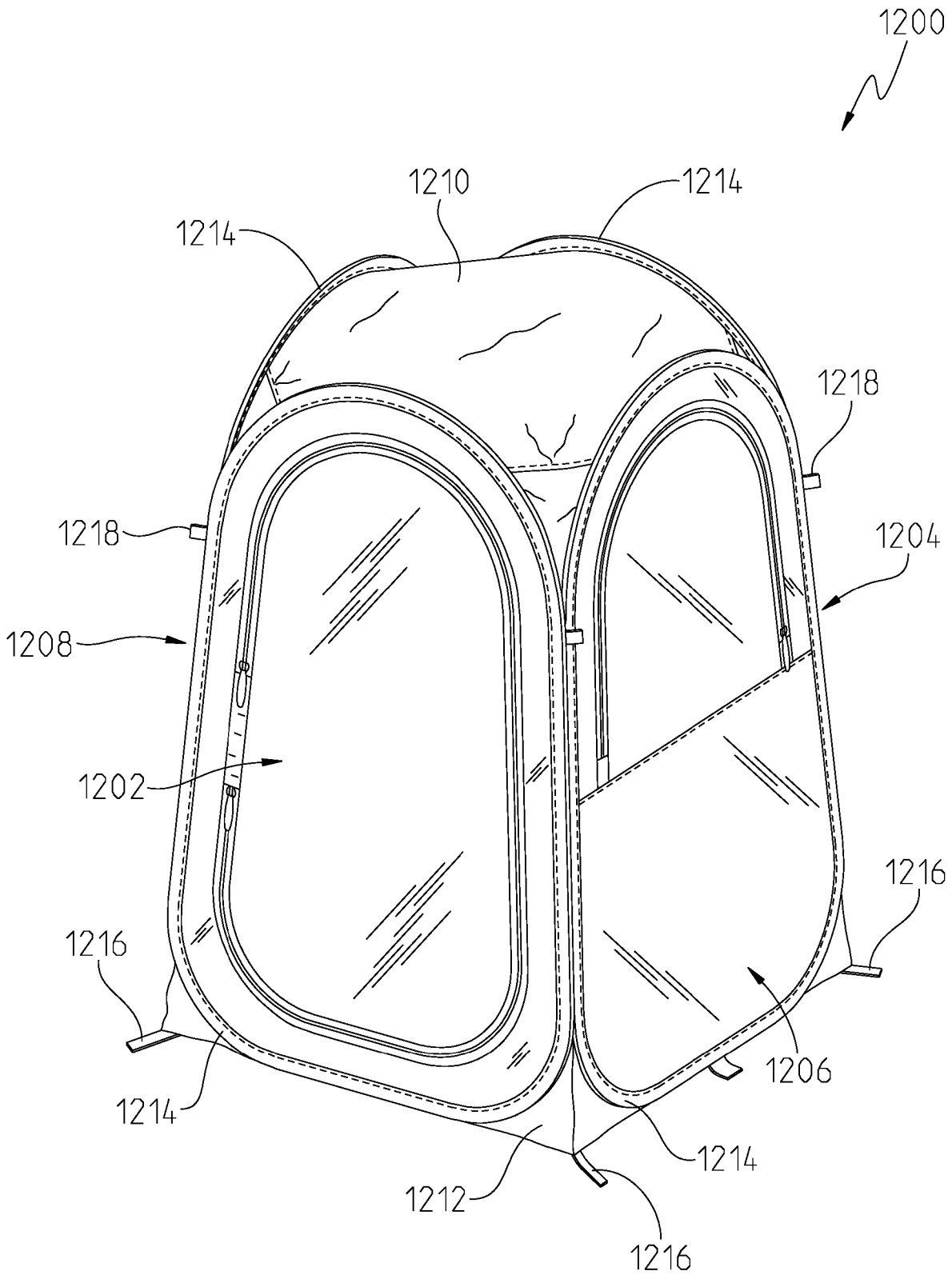
FIG. 9 is a perspective view of a fourth embodiment of a personal enclosure.

A further embodiment of a tapered pod 1200 is shown in FIGS. 9-11. The enclosure 1200 is similar to the previously described enclosure 1000 of FIGS. 7-8. In FIG. 9, the enclosure 1200 can include a front wall 1202, a back wall 1204, a first side wall 1206, a second side wall 1208, a top wall 1210, and a bottom wall 1212. With a tapered design, the bottom wall 1212 is larger than the top wall 1210. The front, back and side walls can be formed by individual frame members 1214. Each frame member 1214 can have a circular, oval, or egg-like shape. This disclosure, however, is not limited to these shapes and the frame member 1214 can include rectangular, triangular, square, pentagon, hexagon, octagon, or any other type shape.

The enclosure 1200 can also include anchor straps or loops 1216 and roof-connecting straps 1218 similar to those previously described. Thus, a removable roof similar to that shown in FIG. 6 can be used with the enclosure 1200 of FIG. 9.

In FIGS. 10 and 11, the enclosure 1200 is shown in greater detail. In FIG. 10, for example, the front wall 1202 is shown and in FIG. 11 the back wall 1204 is shown. The front wall 1202 is shown with a door 1300 defined therein. The door 1300 can occupy a substantial portion of the front wall 1202 with only a space y1 separating the edge of the door 1300 from the outer edge of the door 1300. The door 1300 can be selectively coupled to the front wall 1202 via a zipper 1302. The zipper 1302 can be manipulated between an open and closed position via a zipper pull 1304. In FIG. 10, there are two zipper pulls 1304 shown. In other embodiments, there can be any number of zipper pulls and so two pulls is not required.

The zipper 1302 has a first zipper end 1306 and a second zipper end 1308. An area 1310 between the zipper ends defines a hinge-like area where the door 1300 can be pivoted or folded to a different side of the enclosure. In FIG. 10, the area 1310 with the hinge-like behavior is located on the left side of the door 1300, but this can differ in other embodiments. For example, the area 1310 can be located on the top or right side of the wall. If on the top side, then the door 1300 can be opened and folded on top of the top wall 1210. The door 1300 can include a connector such as hook and loop system, a snap, latch, hook, or the like for engaging with another connector to fasten or hold the door in its open position.

In FIG. 11, the back wall 1204 of the enclosure 1200 is shown. Here, the back wall 1204 can include a second door 1400 defined therein. The door 1400 can be selectively coupled to the back wall 1204 via a zipper 1402. One or more zipper pulls 1404 can be used to manipulate the zipper 1402 between its open and closed position. Likewise, the zipper 1402 can include a first zipper end 1406 and a second zipper end 1408. In FIG. 11, the door 1400 is such that the zipper ends are disposed near the top of the back wall 1204. A shade or cover 1410 is formed at a location between or above the zipper 1402.

As shown in FIG. 11, the door 1400 can have a bottom edge that is spaced from the bottom edge of the back wall 1204 by a distance y2. This distance y2 is smaller than distance y1 of FIG. 10. Distance y2 can be less than 1-2 inches. In another embodiment, it can be less than 5 inches. In any event, the distance y2 is less than distance y1. With a smaller gap separating the bottom of the door 1600 from the bottom of the wall (and, thus the ground surface), a wheelchair can be easily transported into the enclosure 1200 through the door opening.

Figure 12:
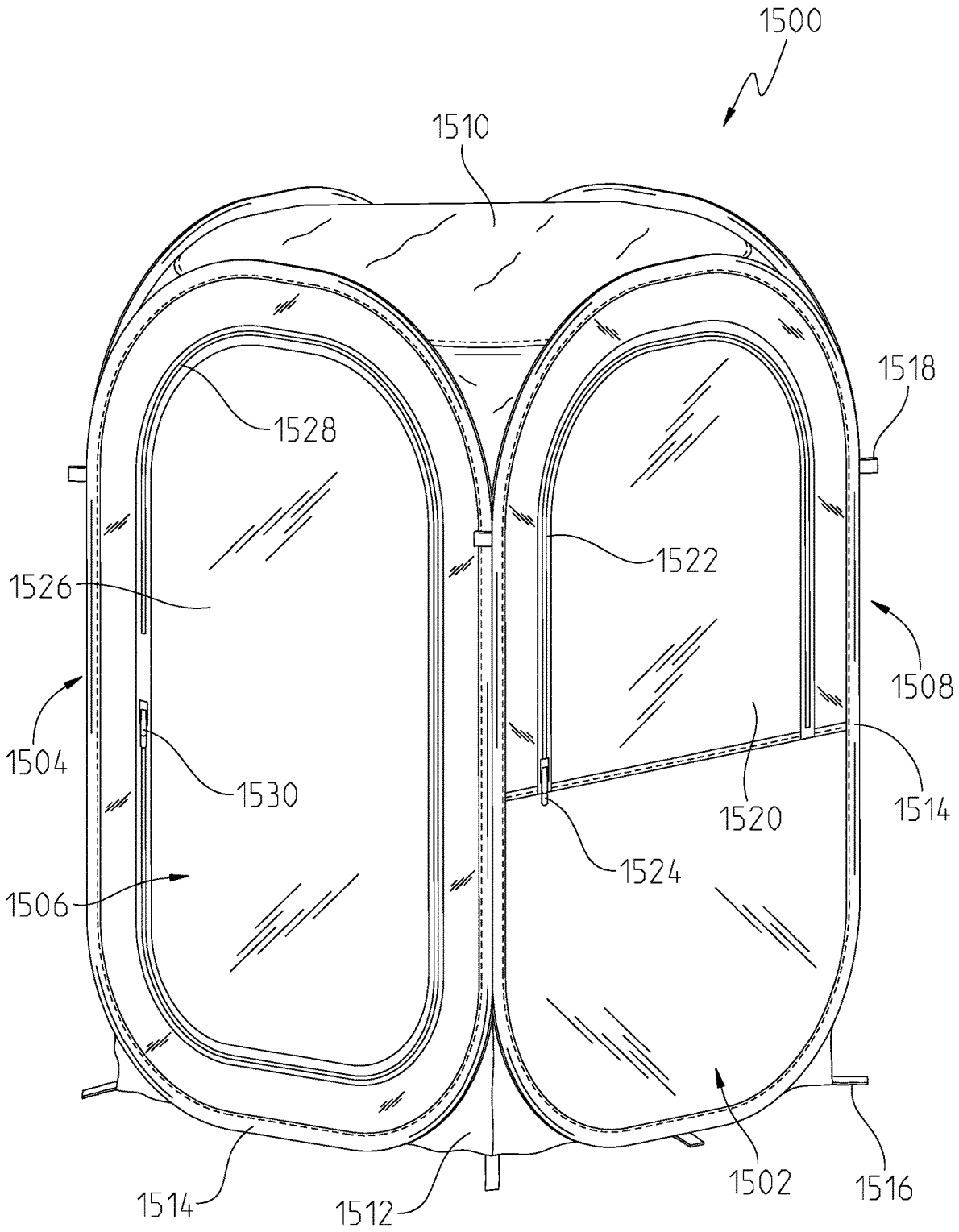
FIG. 12 is a perspective view of a fifth embodiment of a personal enclosure.

In FIG. 12, a different embodiment of an enclosure 1500 is shown. The enclosure 1500 can include a plurality of walls similar to those previously described. Here, the enclosure 1500 includes a front wall 1502, a back wall 1504, a first side wall 1506, a second side wall 1508, a top wall 1510, and a bottom wall 1512. Similar to the previous embodiments, a frame member 1514 can provide support to each wall, and in particular to the front, back and side walls. The enclosure 1500 can include anchoring straps or loops 1516 for anchoring the enclosure 1500 in place.

Figure 13:
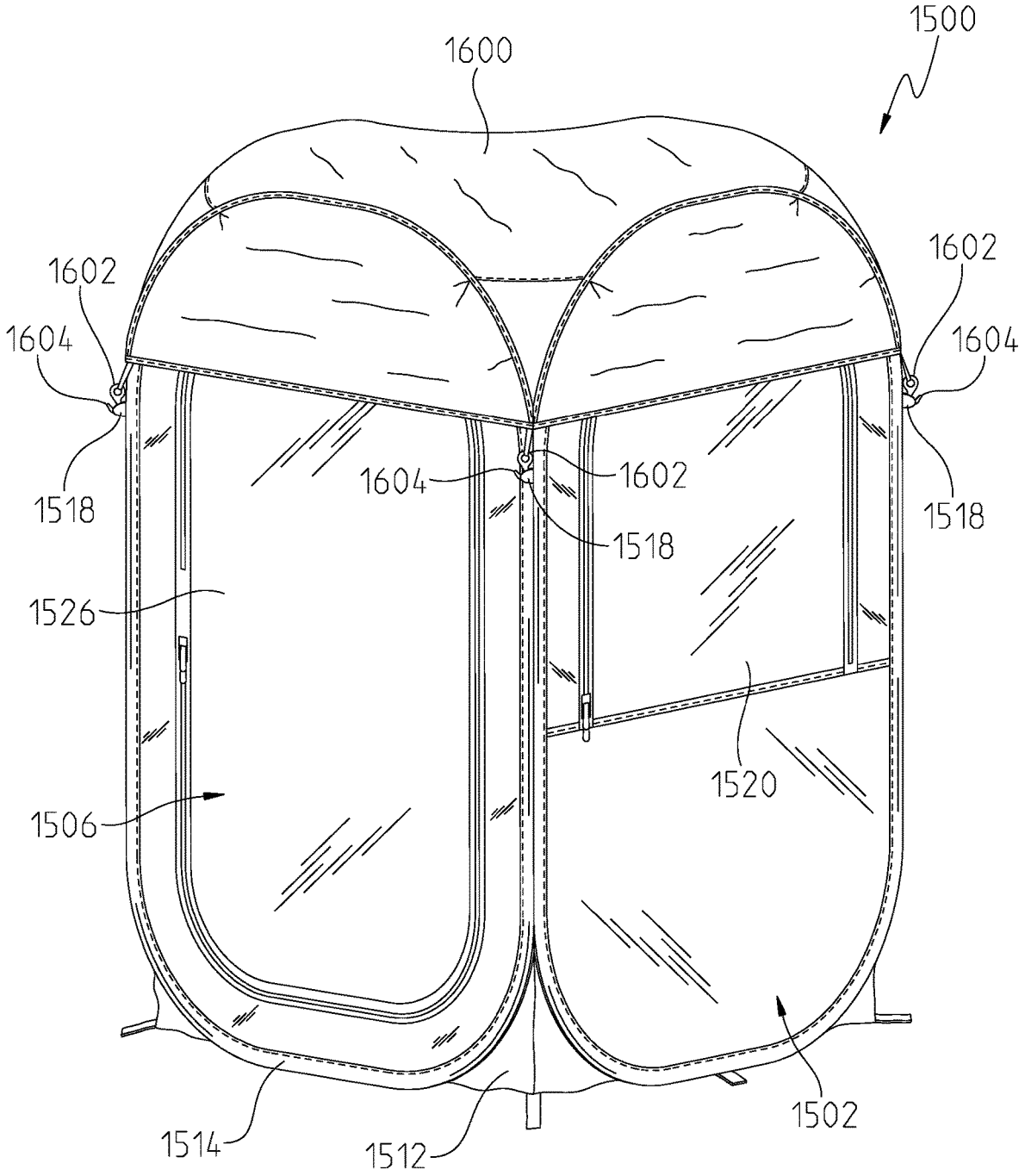
FIG. 13 is a perspective view of a sixth embodiment of a personal enclosure.

Straps 1518 can be coupled at one or more locations on the enclosure 1500 for coupling to a roof structure 1600 as shown in FIG. 13. Here, the roof structure 1600 can include one or more connectors 1602 that each include a hook end 1604. The hook end 1604 can be disposed through an opening in a strap 1518 for coupling the roof structure 1600 to the enclosure 1500.

The enclosure 1500 can also include a window 1520 defined in the front wall 1502. The window 1520 can be selectively engaged with the front wall 1502 via a zipper 1522. A zipper pull 1524 can be used to manipulate the zipper 1522 to position the window 1520 between an open and closed position.

A door 1526 can be formed in at least the first side wall 1506 to allow a user to enter or exit the enclosure 1500. The door 1526 can be selectively engaged with the side wall via a zipper 1528. One or more zipper pulls 1530 can be used to manipulate the zipper 1528 so that the door 1526 can be opened or closed.

Figure 14:
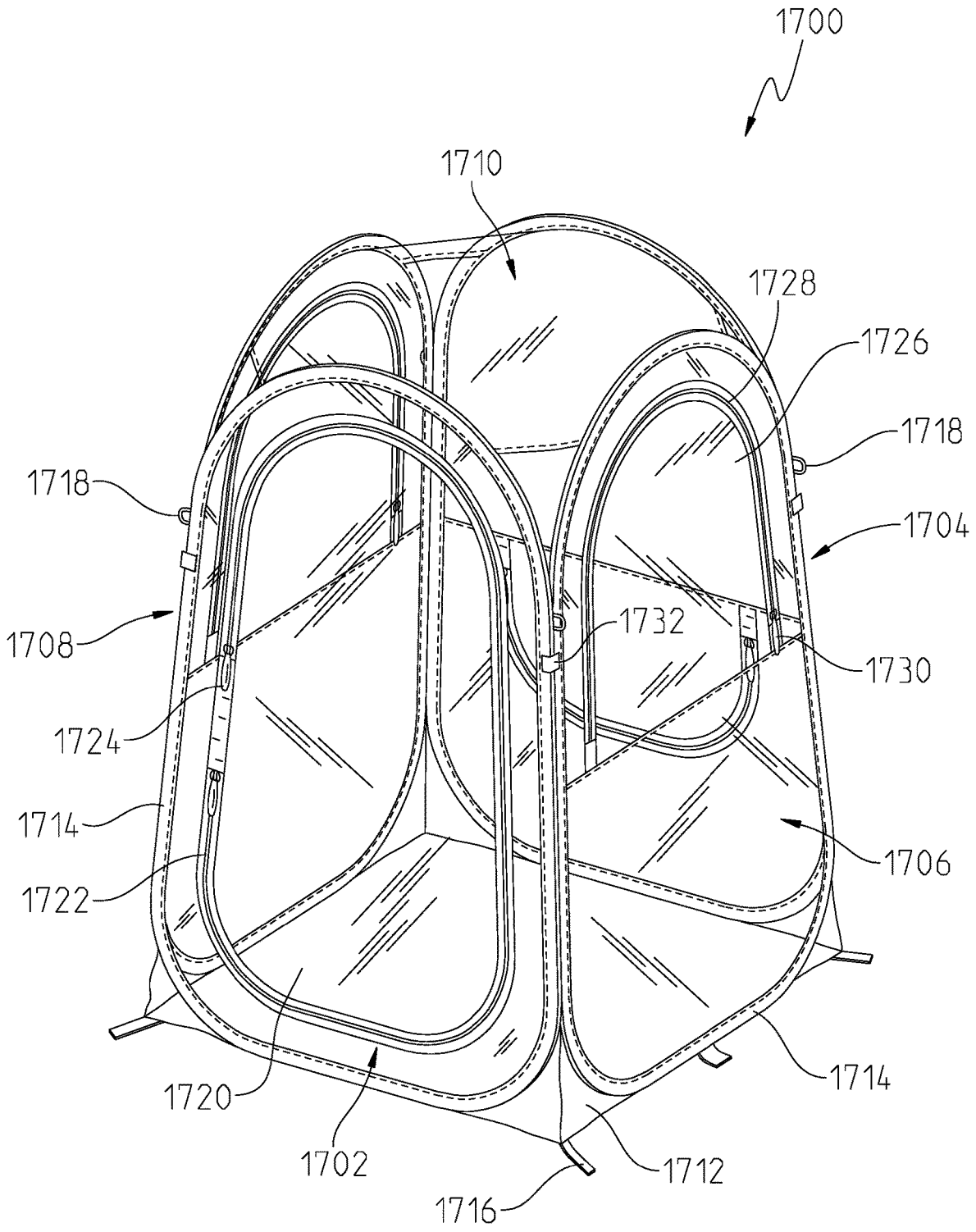
FIG. 14 is a perspective view of a seventh embodiment of a personal enclosure.

A further embodiment of an enclosure 1700 is shown in FIG. 14. This enclosure 1700 includes a tapered design with a plurality of walls. For instance, the enclosure 1700 can include a front wall 1702, a back wall 1704, a first side wall 1706, a second side wall 1708, a top wall 1710, and a bottom wall 1712. Similar to the previous embodiments, a frame member 1714 can provide support to each wall, and in particular to the front, back and side walls. The enclosure 1700 can include anchoring straps or loops 1716 for anchoring the enclosure 1700 in place, and straps or hooks 1718 for coupling to a separate roof structure (not shown).

Figure 17:
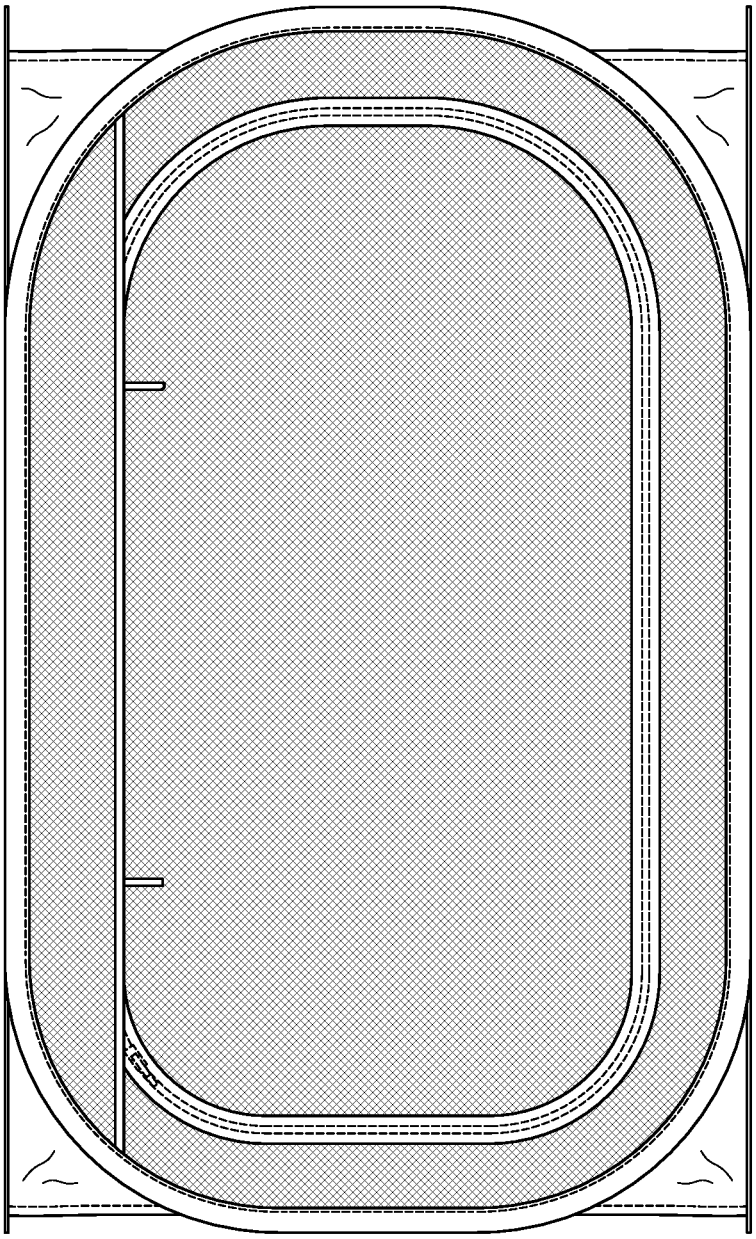
Figure 18:
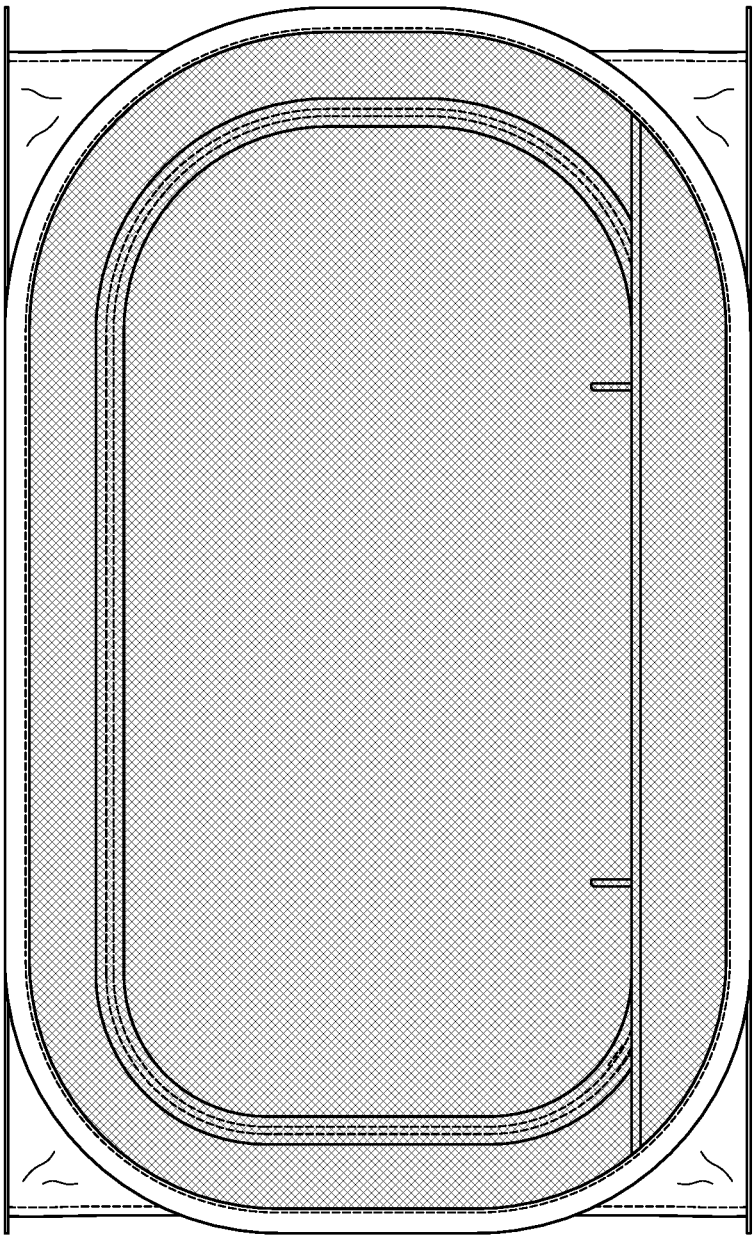
Figure 19:
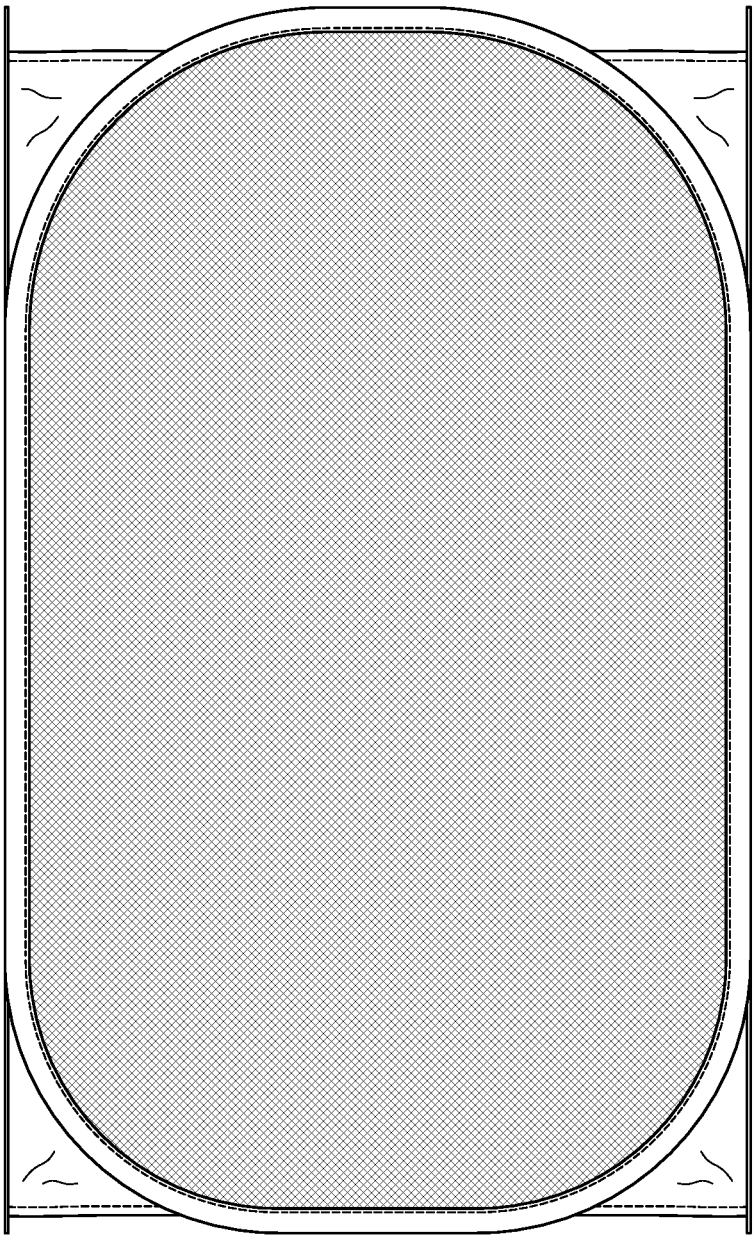
Figure 20:
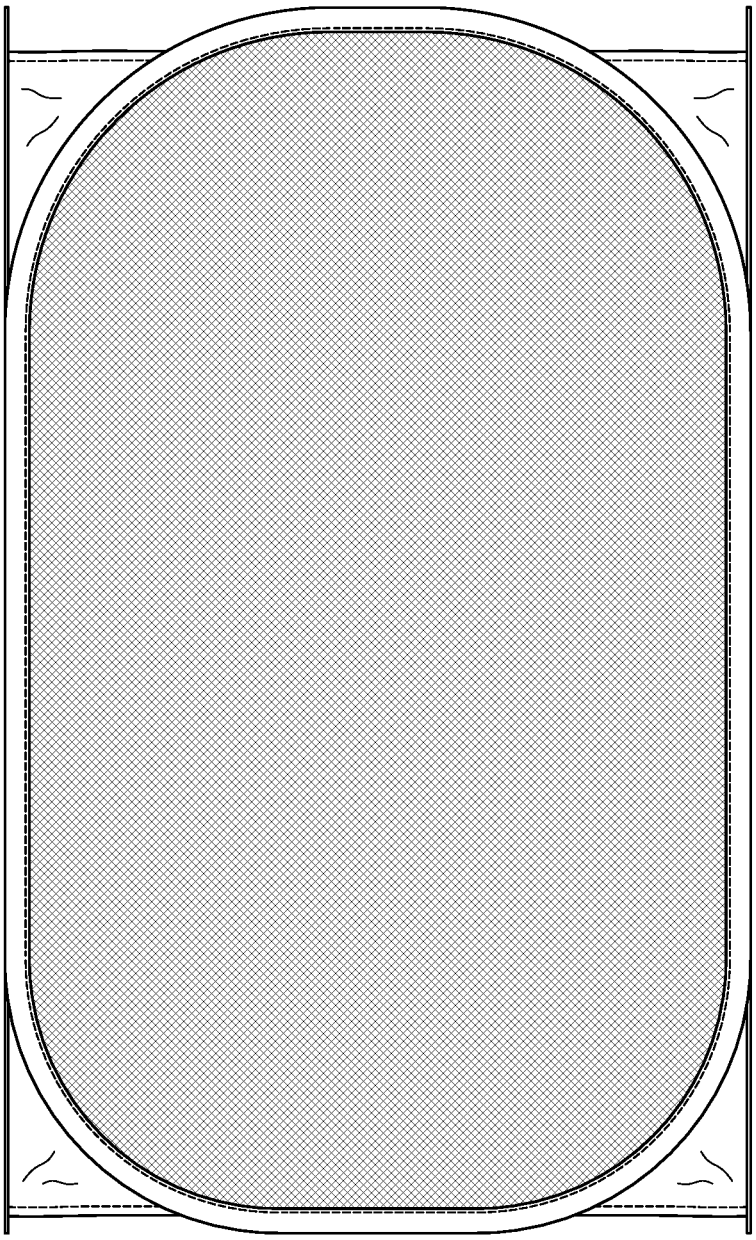
Figure 21:
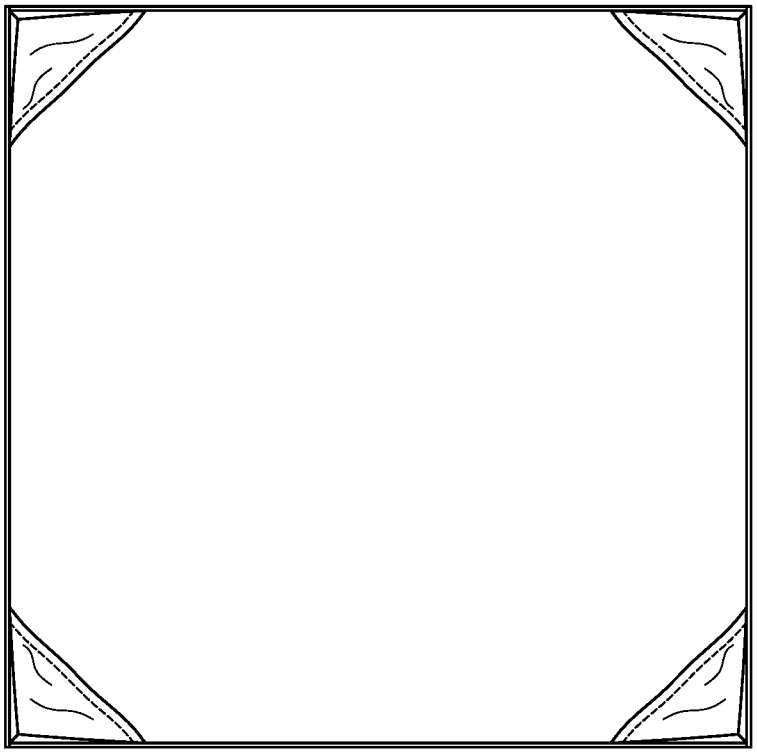
Figure 22:
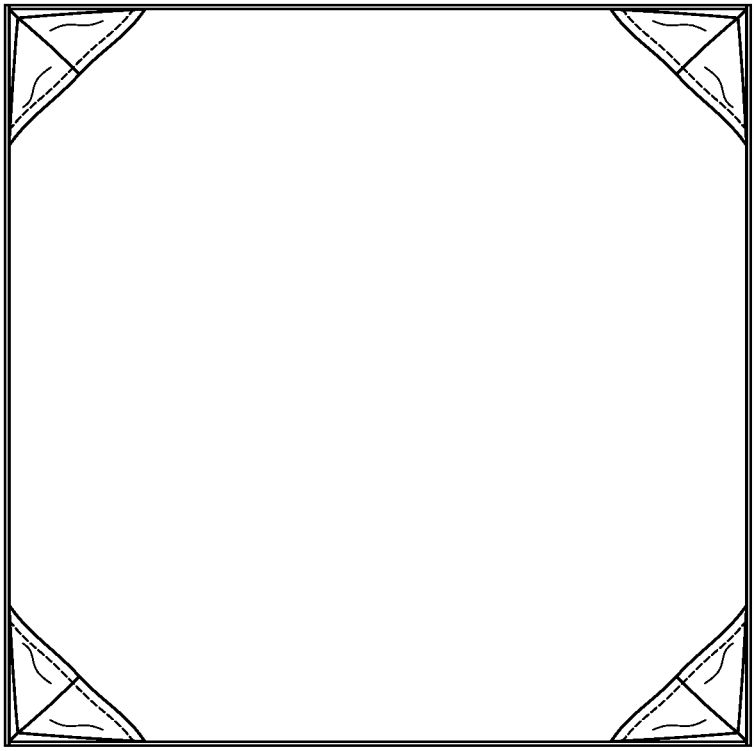
Figure 23:
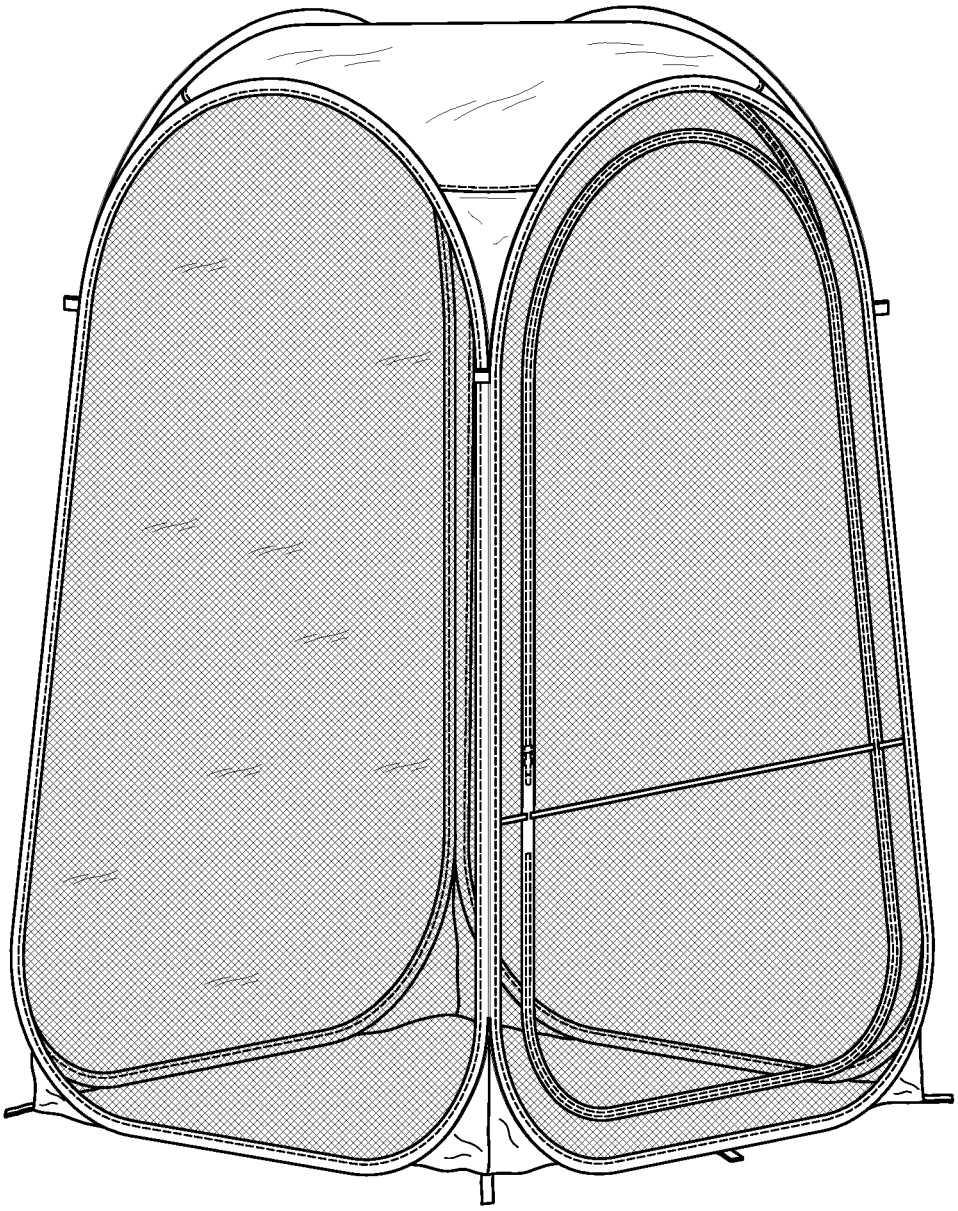
FIGS. 23-29 are figures depicting a personal enclosure that can also be used as an insert with tapered sides.
Figure 24:
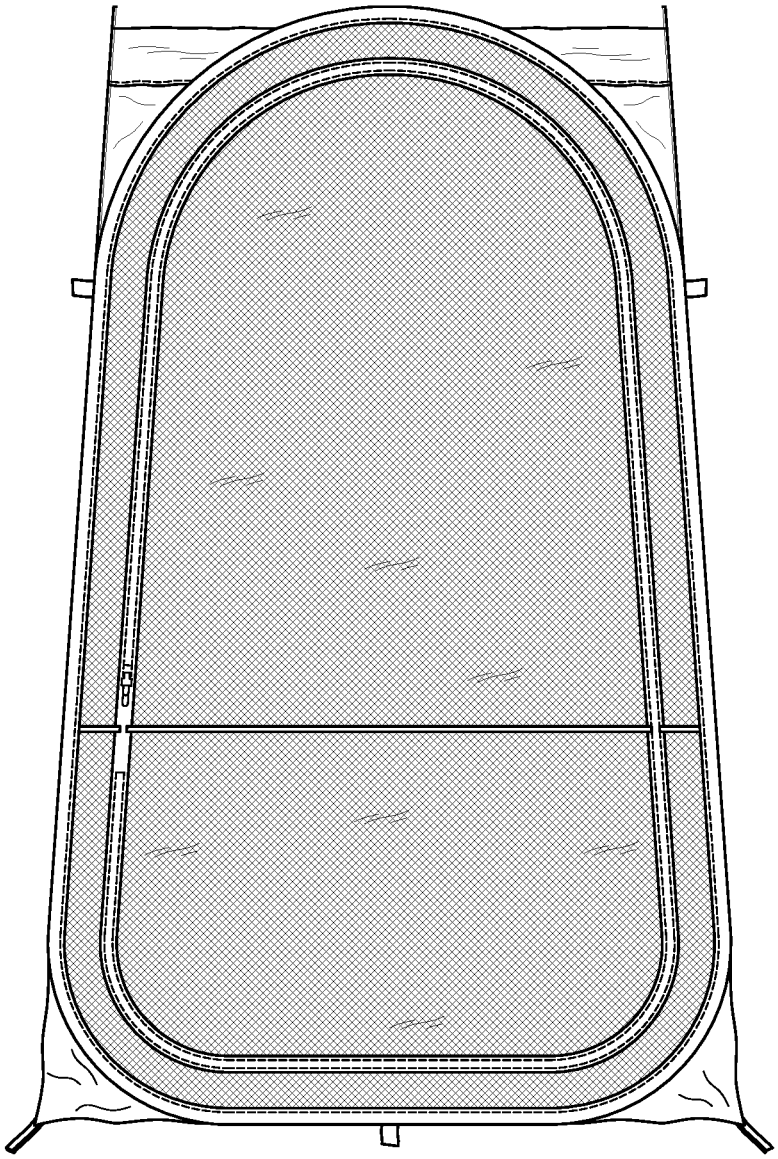
Figure 25:
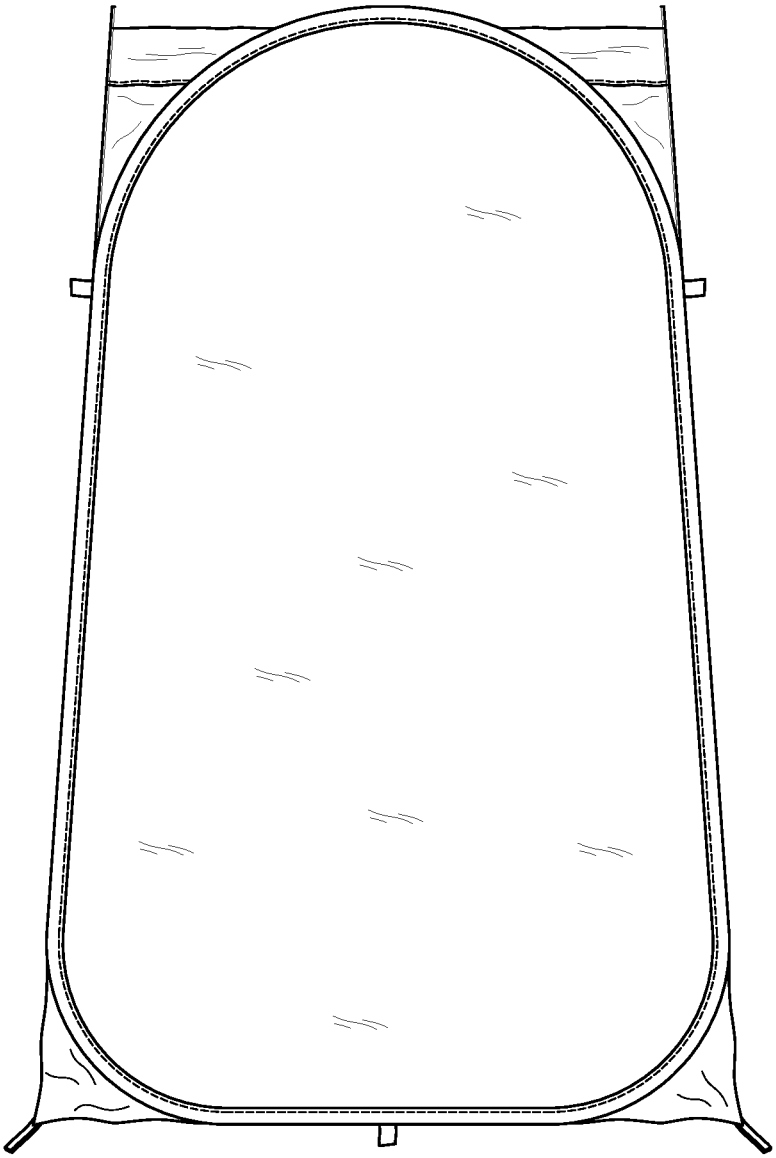
Figure 26:
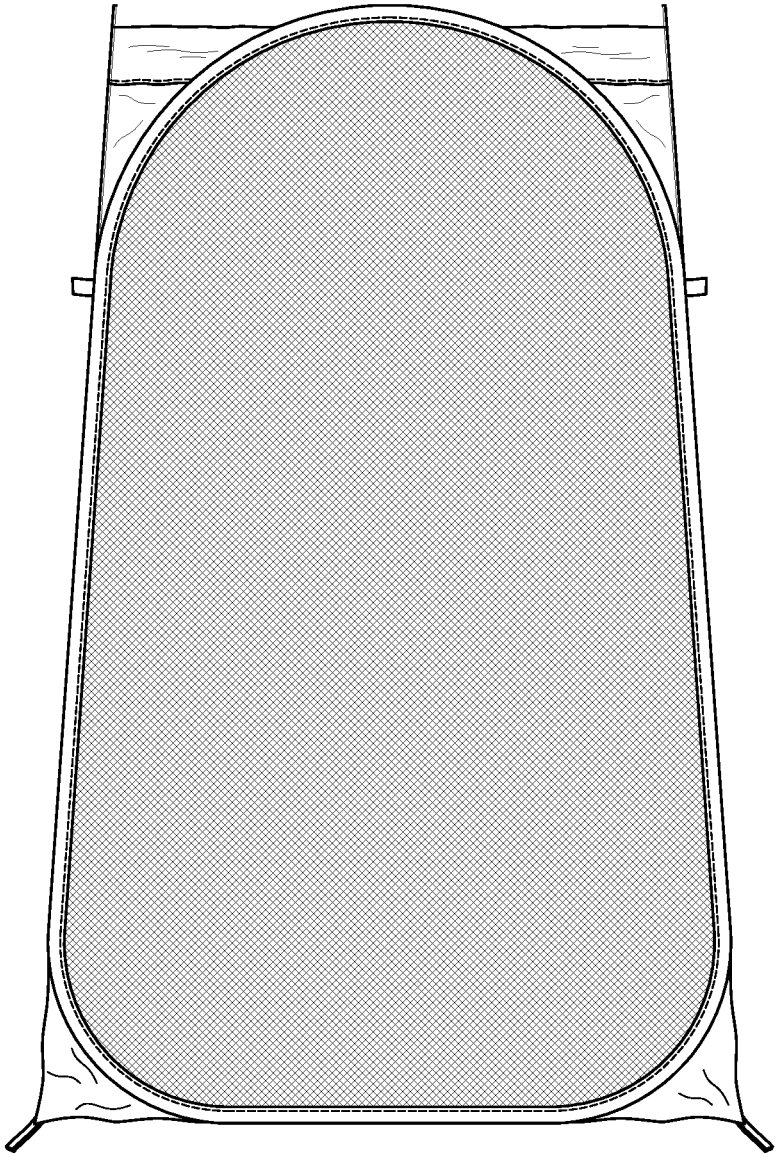
Figure 27:
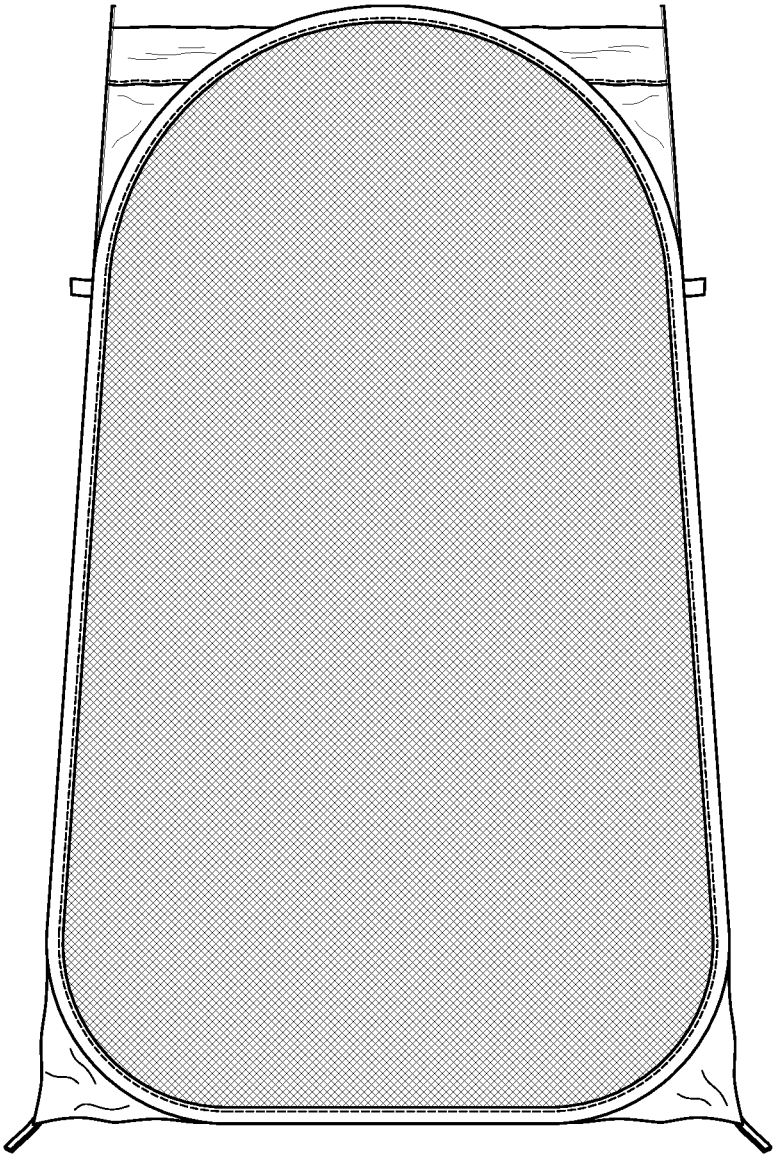
Figure 28:
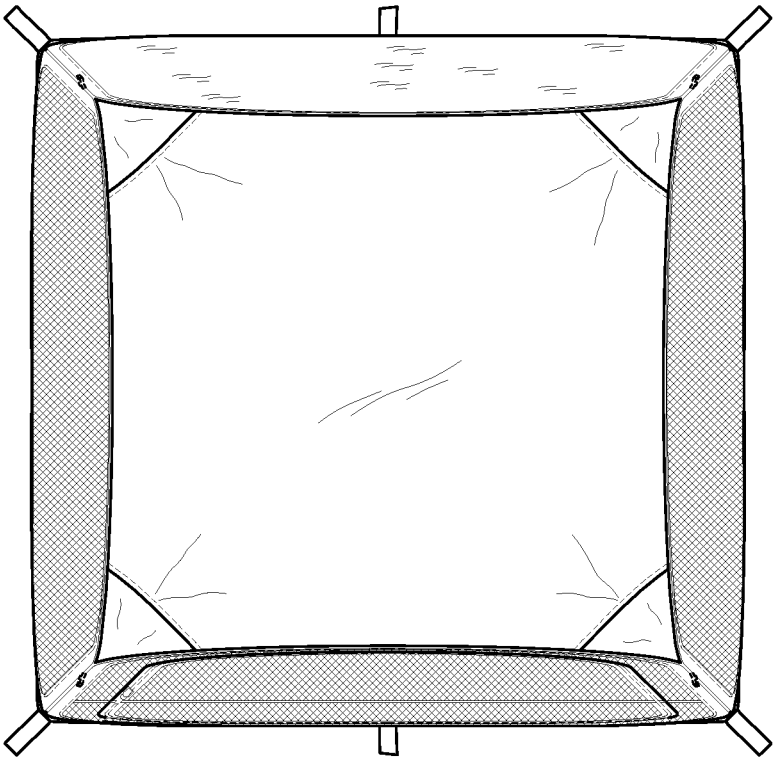
Figure 29:
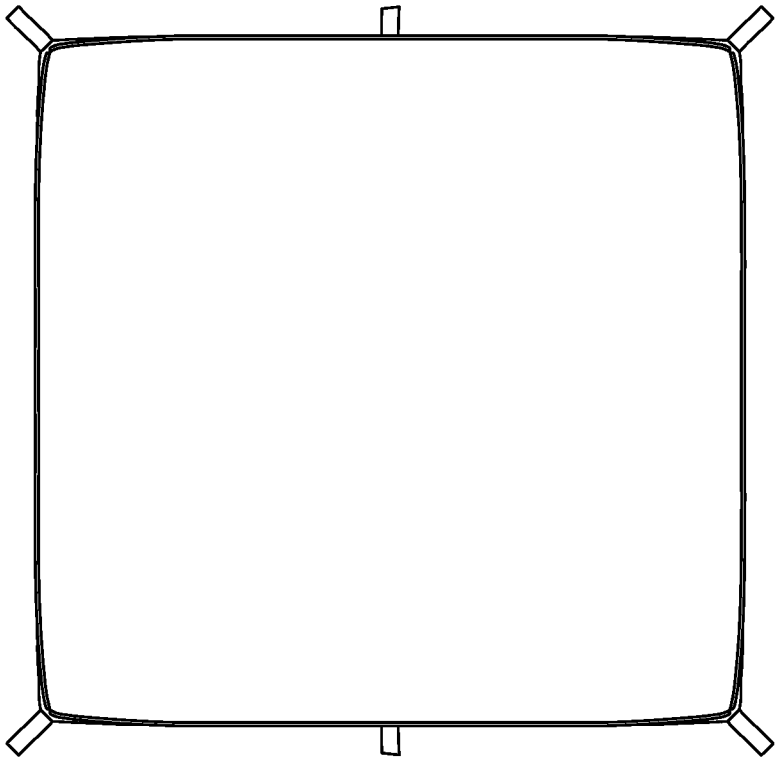
Figure 30:
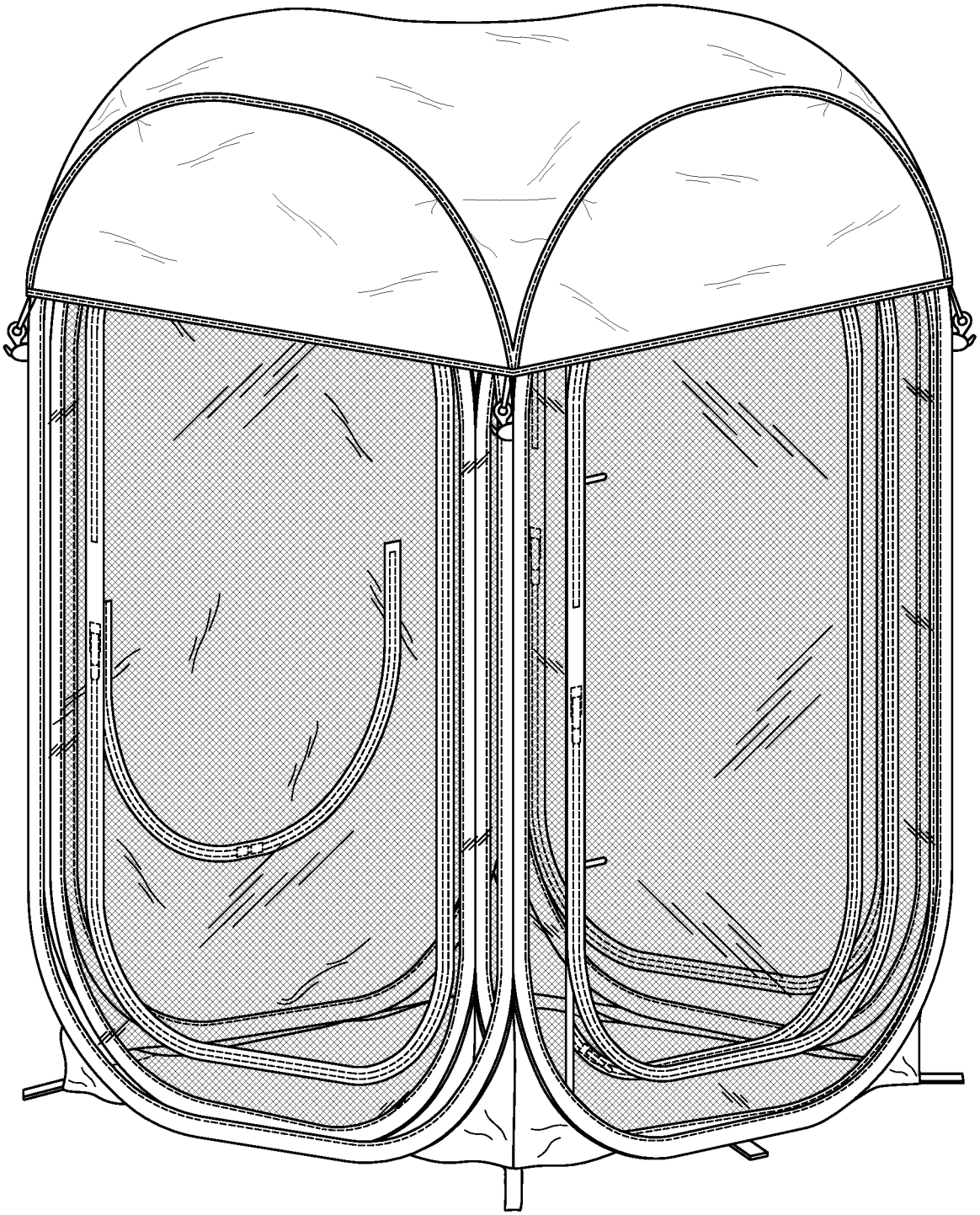
FIGS. 30-36 are figures of an insert with parallel sides positioned inside a personal enclosure with parallel sides with a roof.
Figure 31:
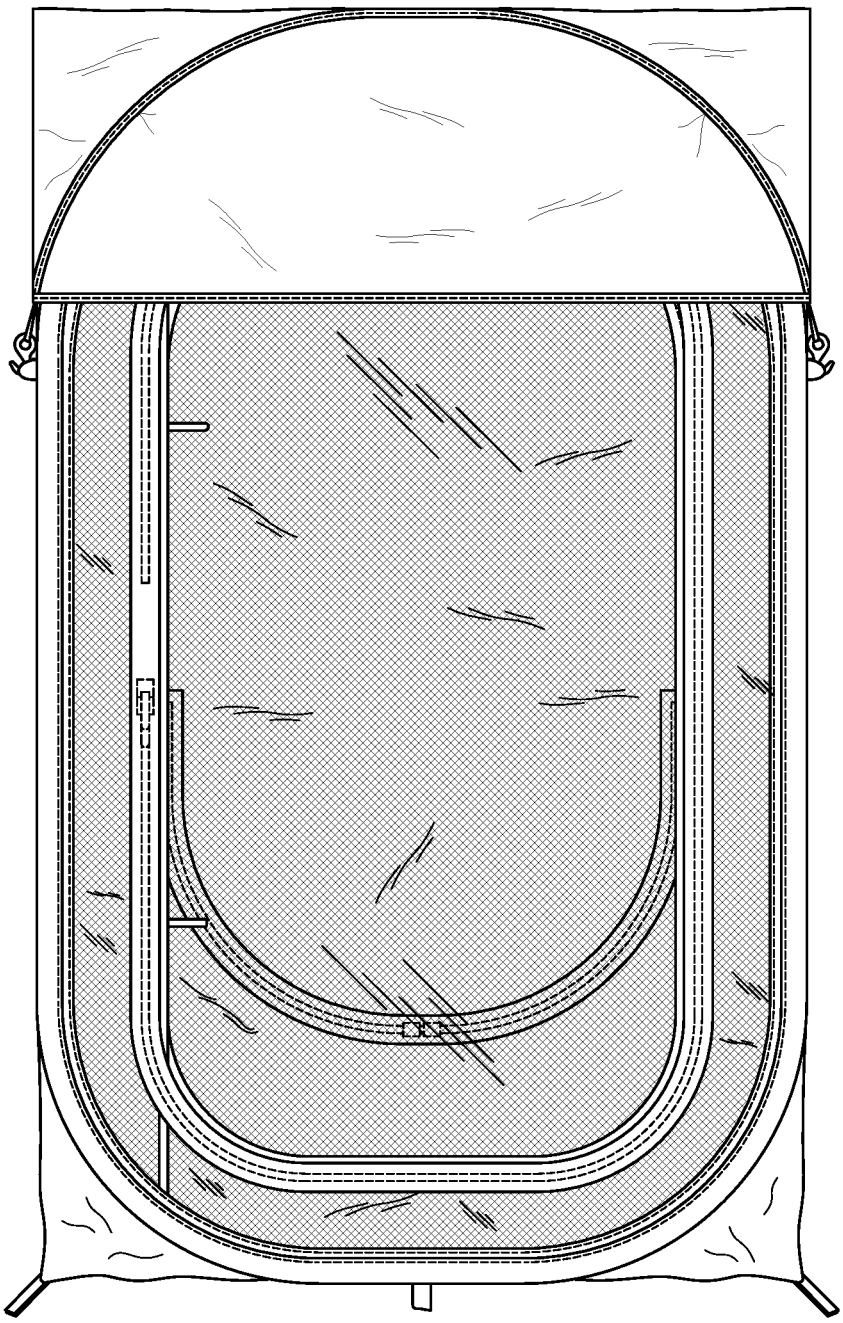
Figure 32:
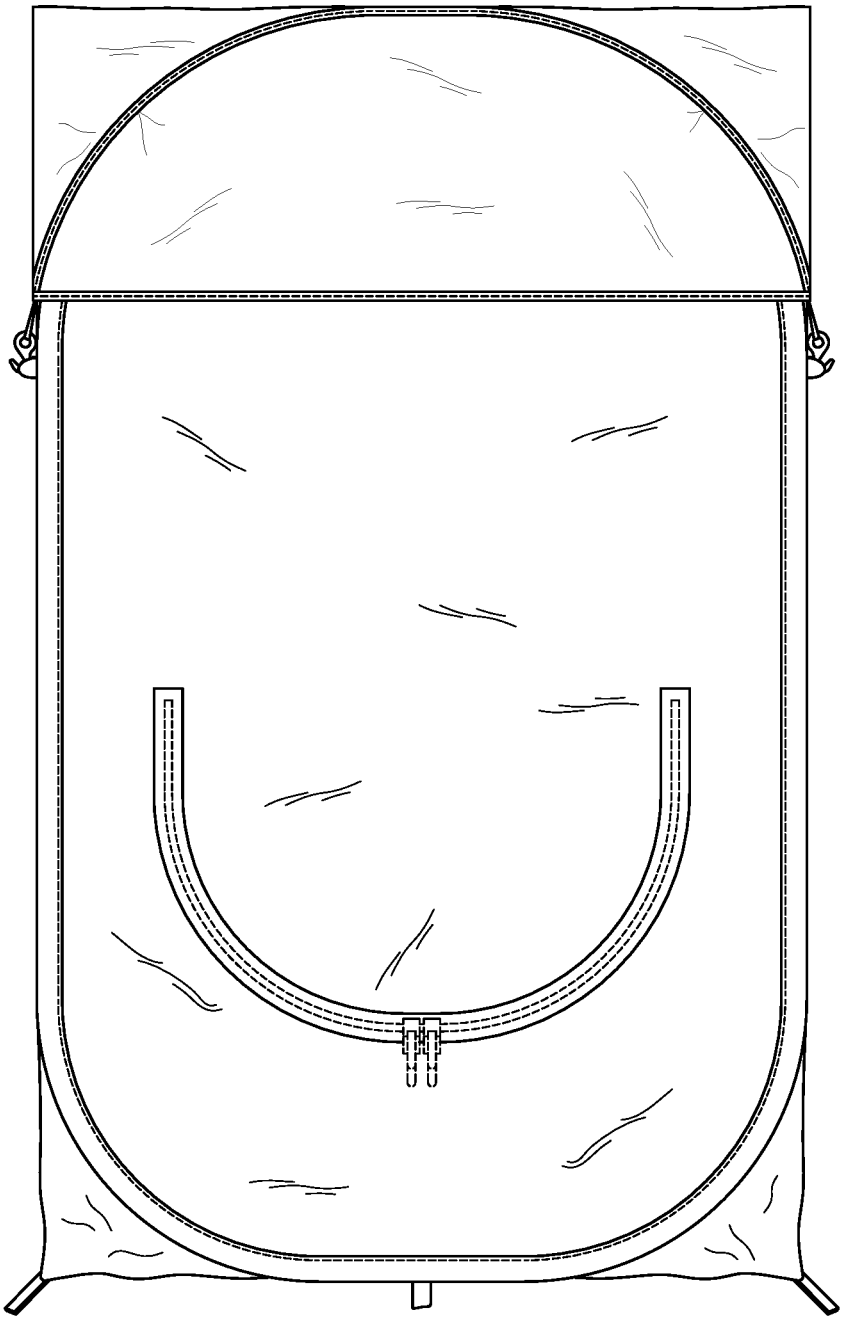
Figure 33:
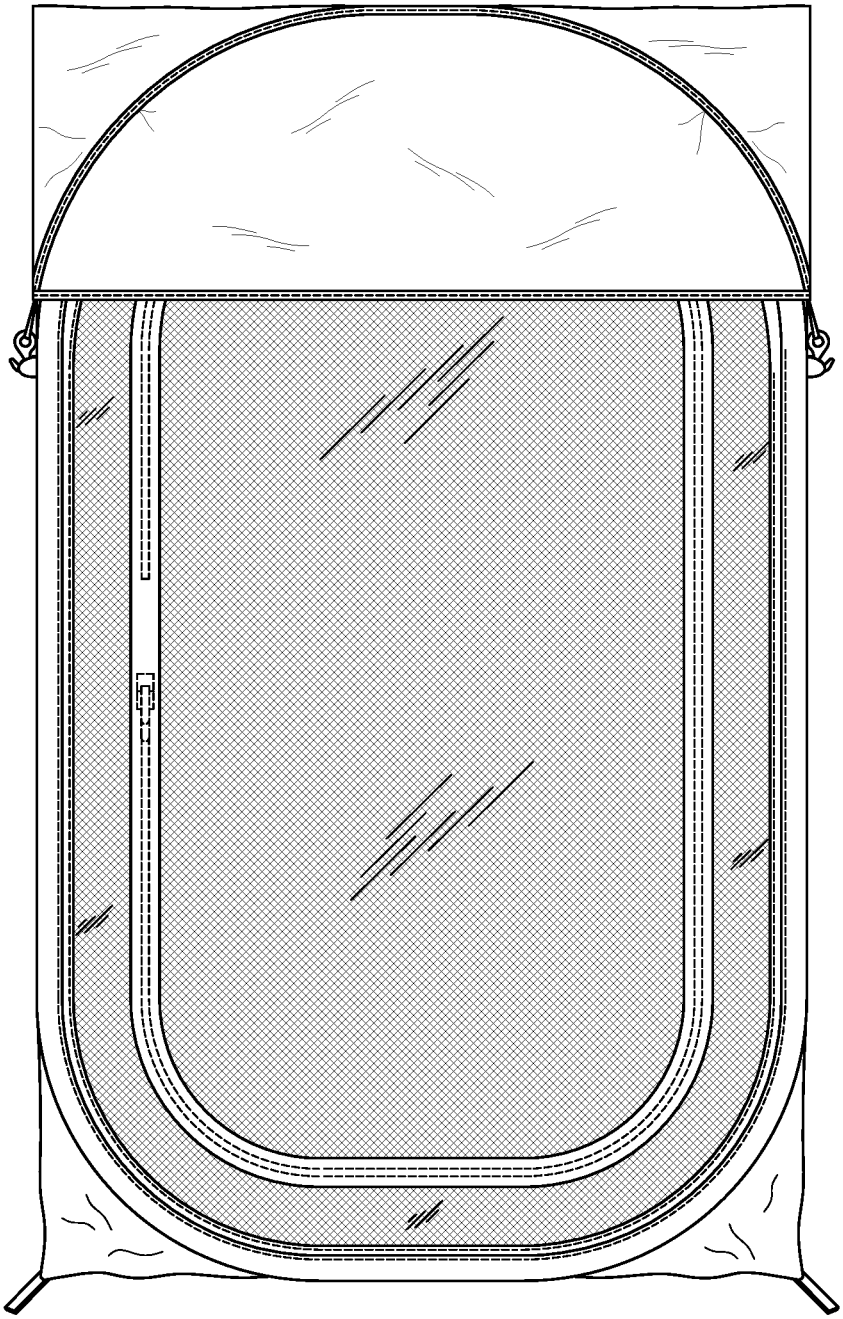
Figure 34:
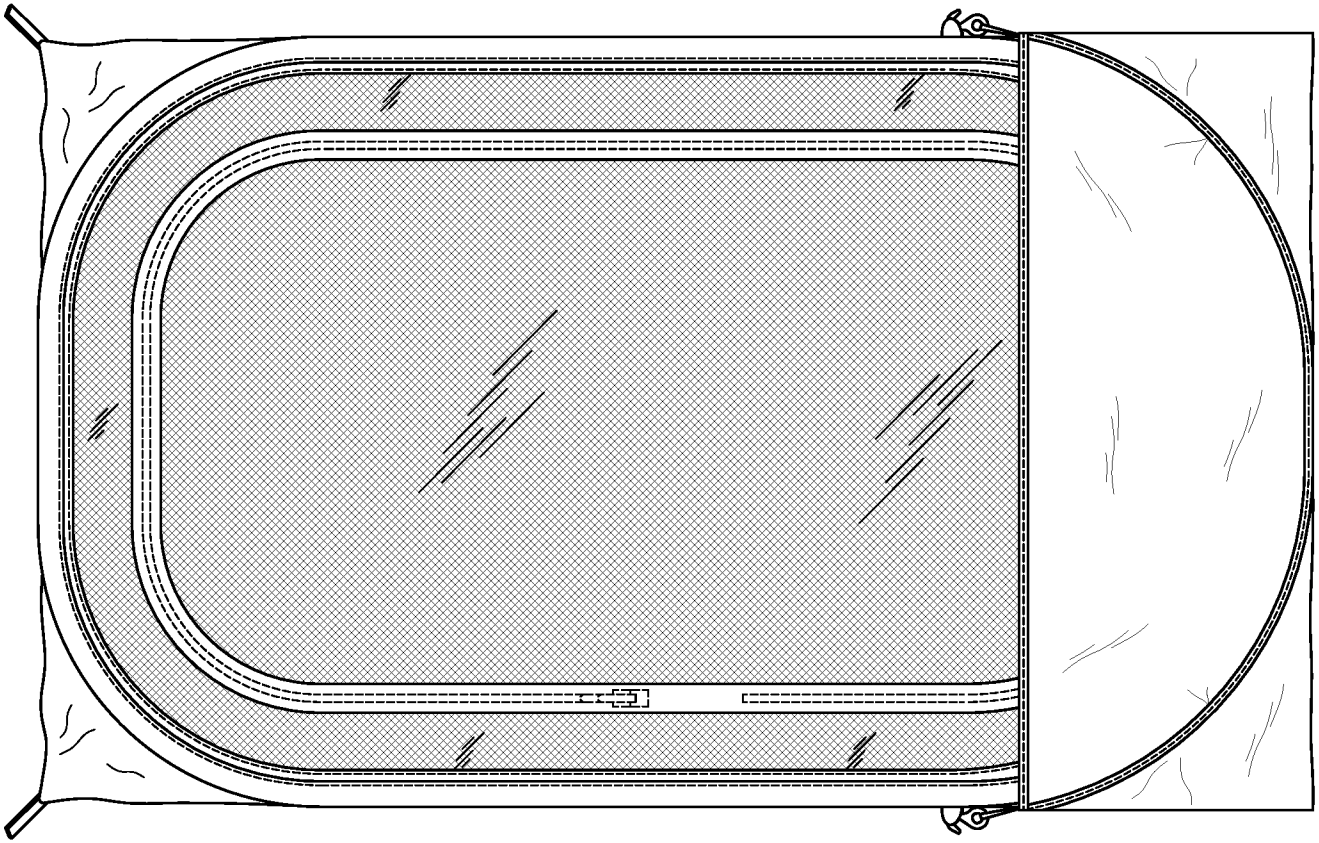
Figure 35:
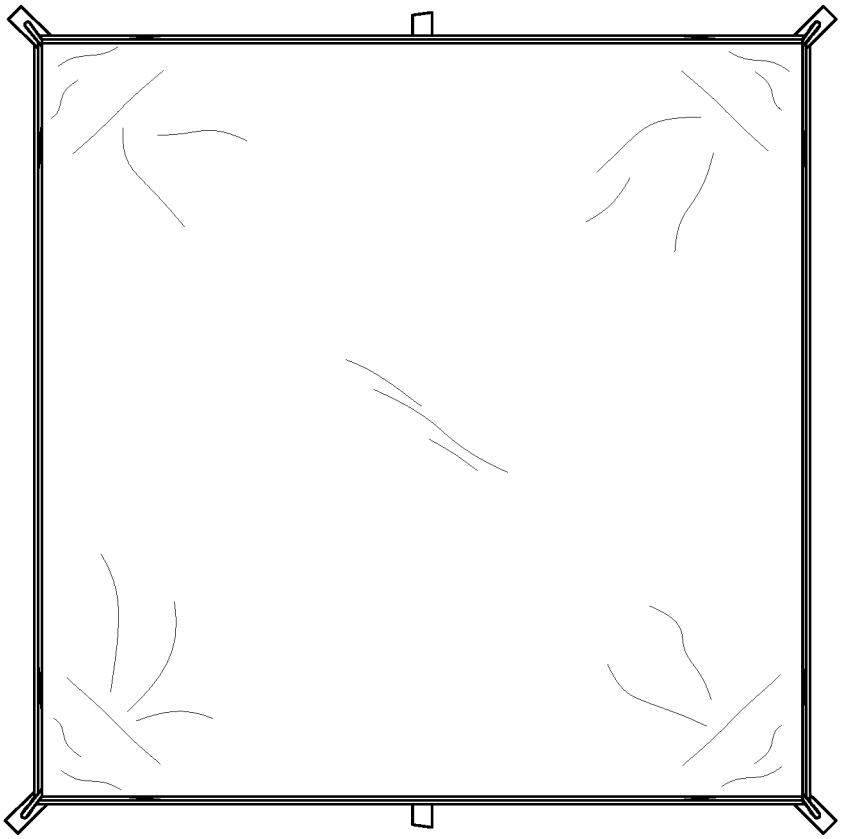
Figure 36:
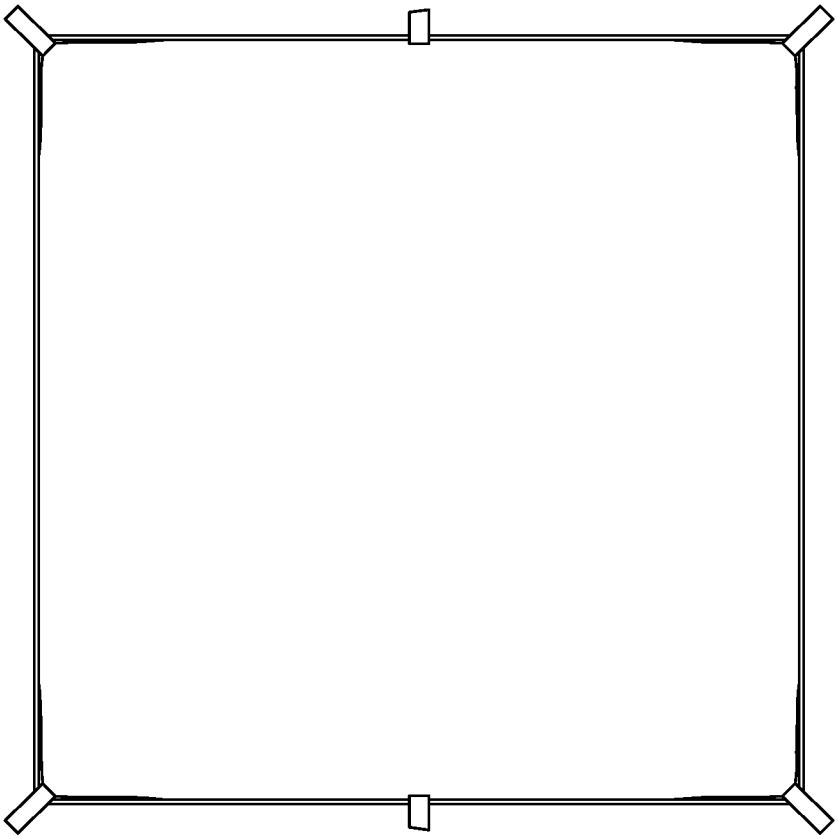
Figure 37:
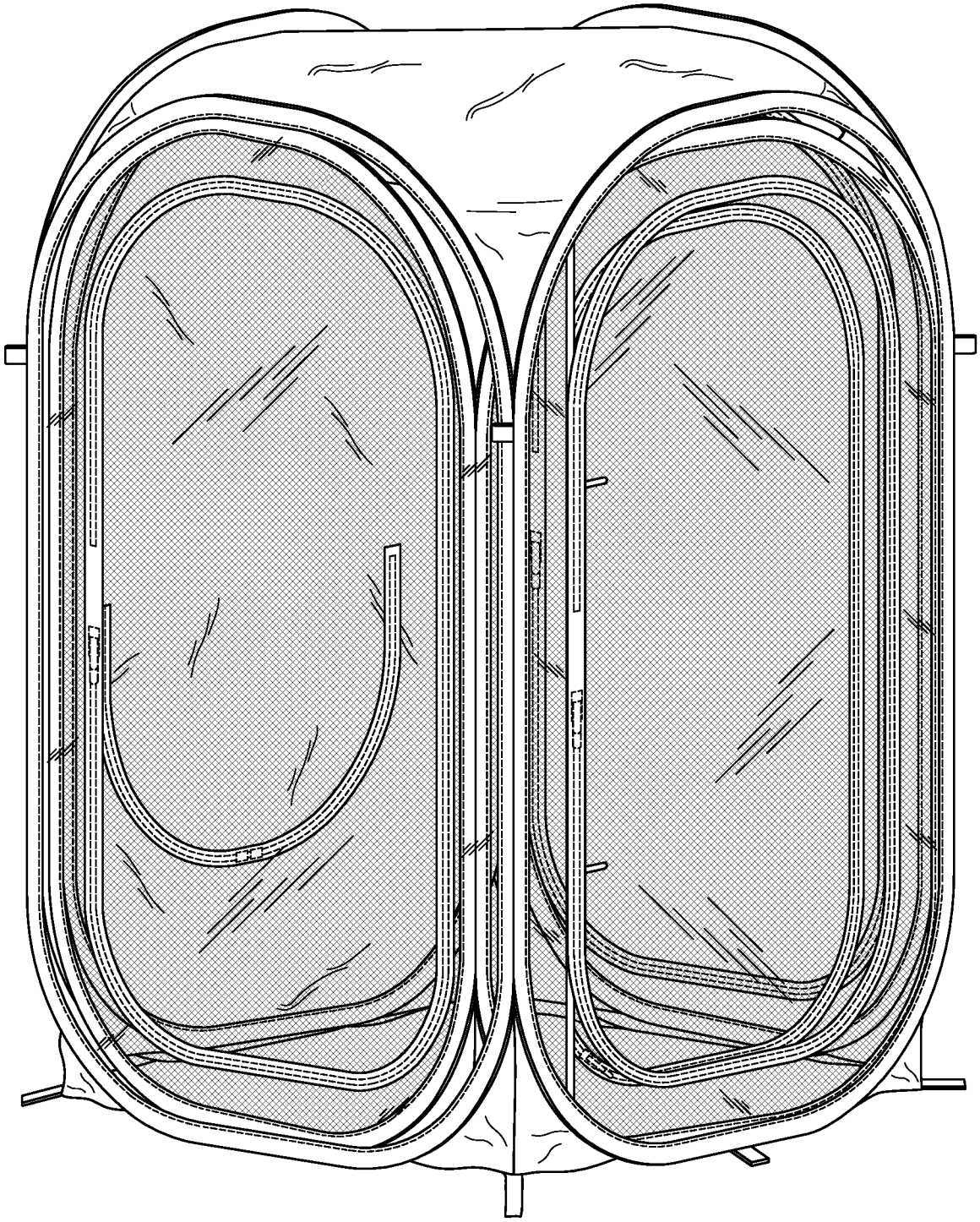
FIGS. 37-43 are figures of an insert with parallel sides positioned inside a personal enclosure with parallel sides.
Figure 38:
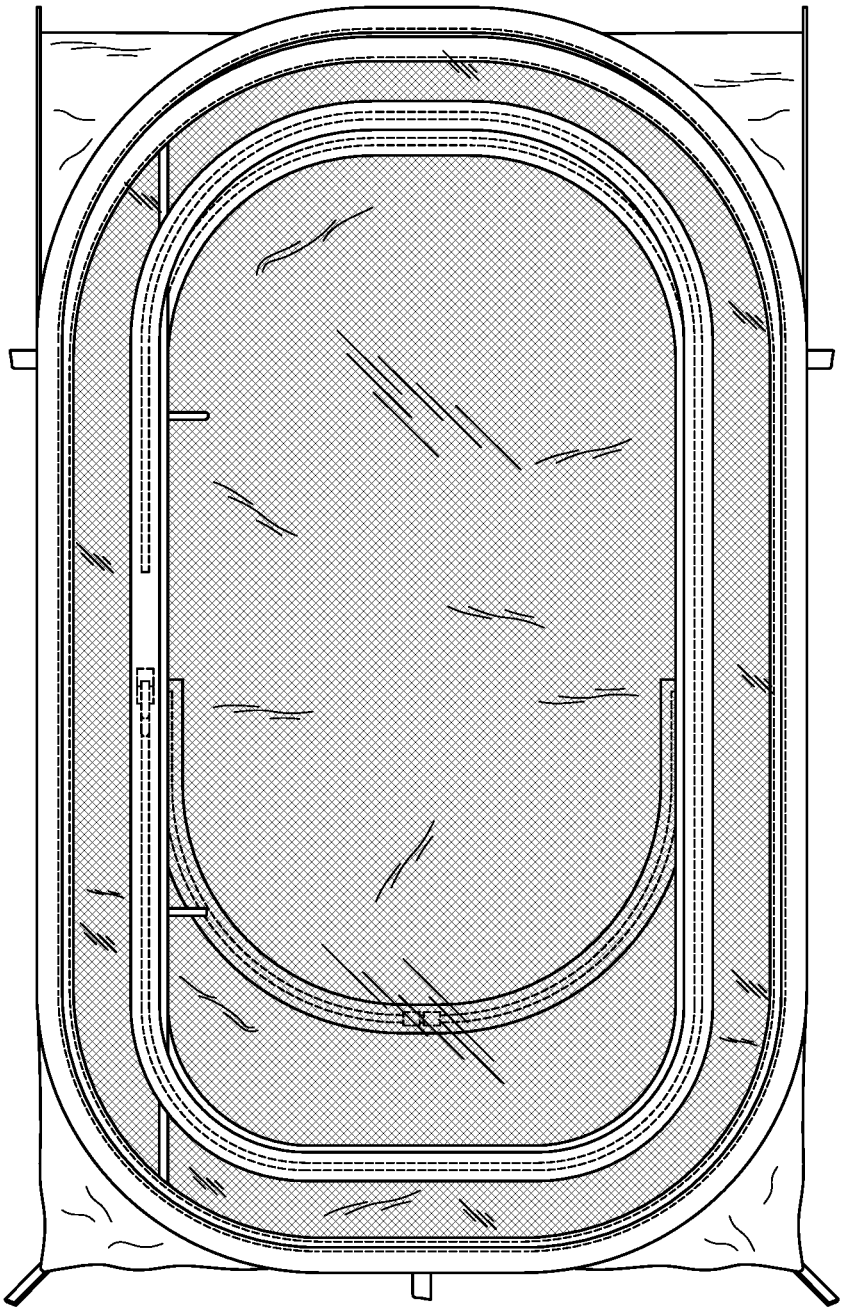
Figure 39:
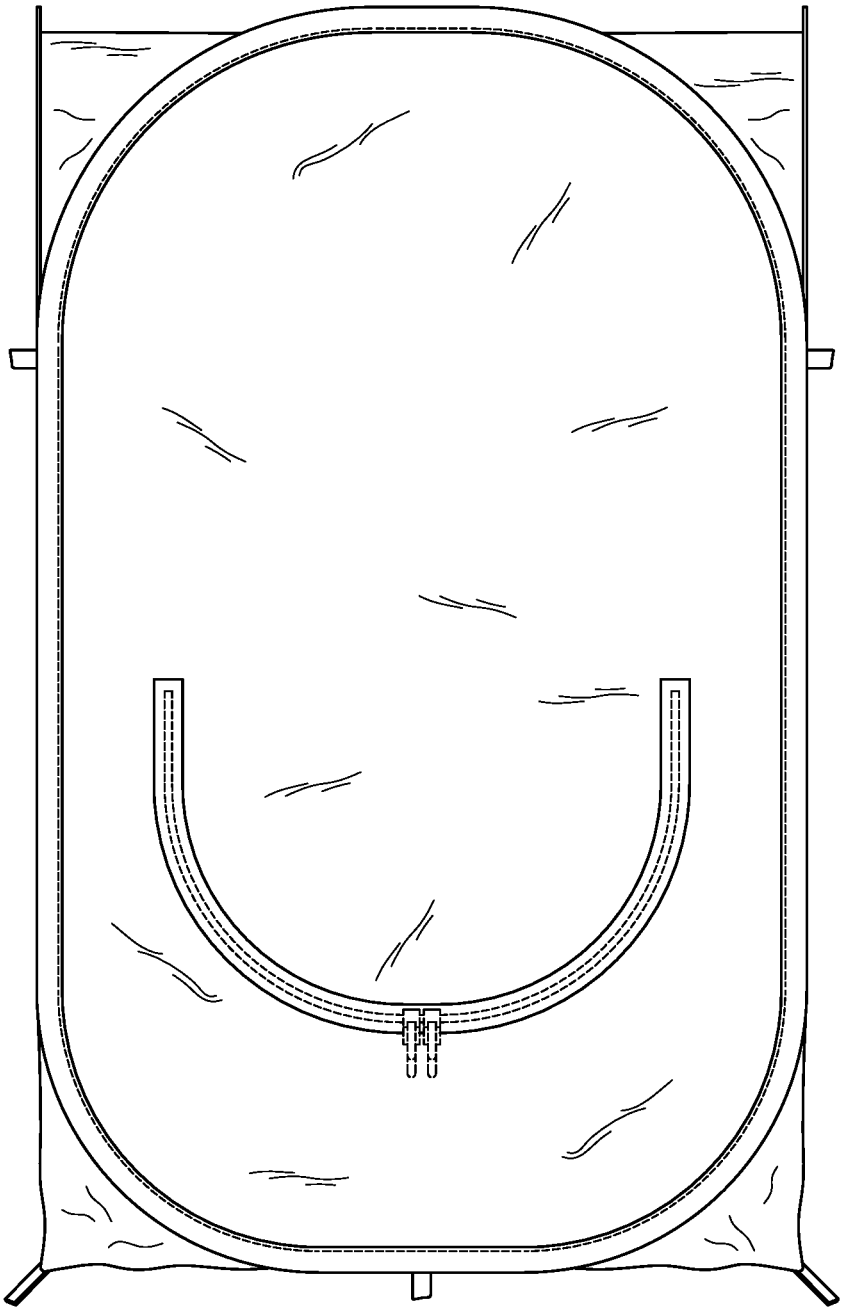
Figure 40:
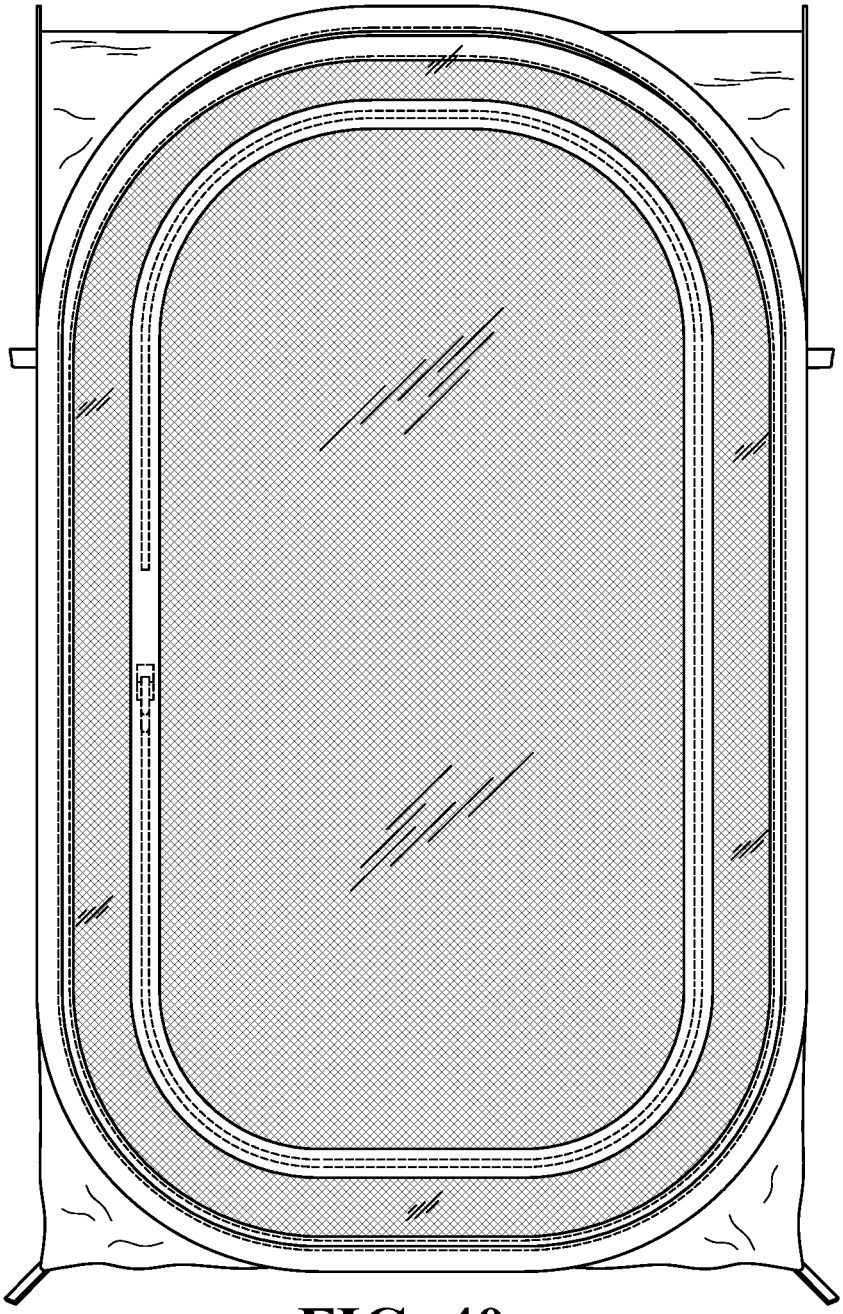
Figure 41:
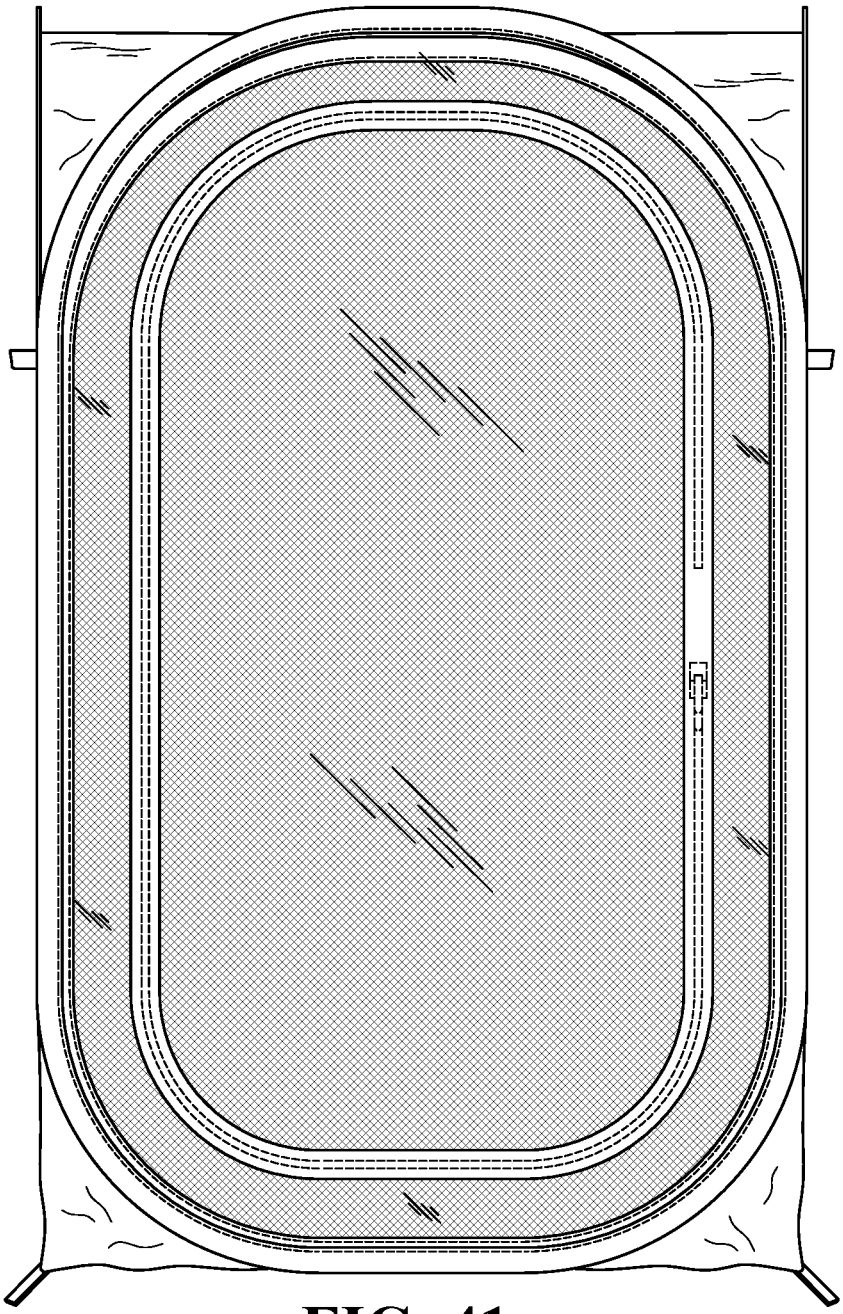
Figure 42:
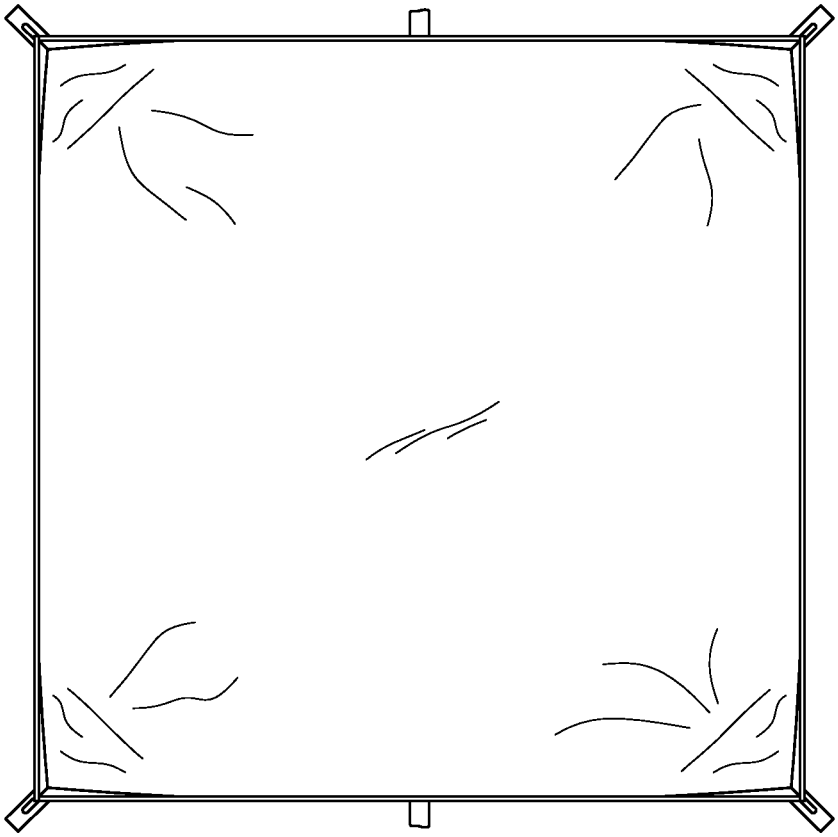
Figure 43:
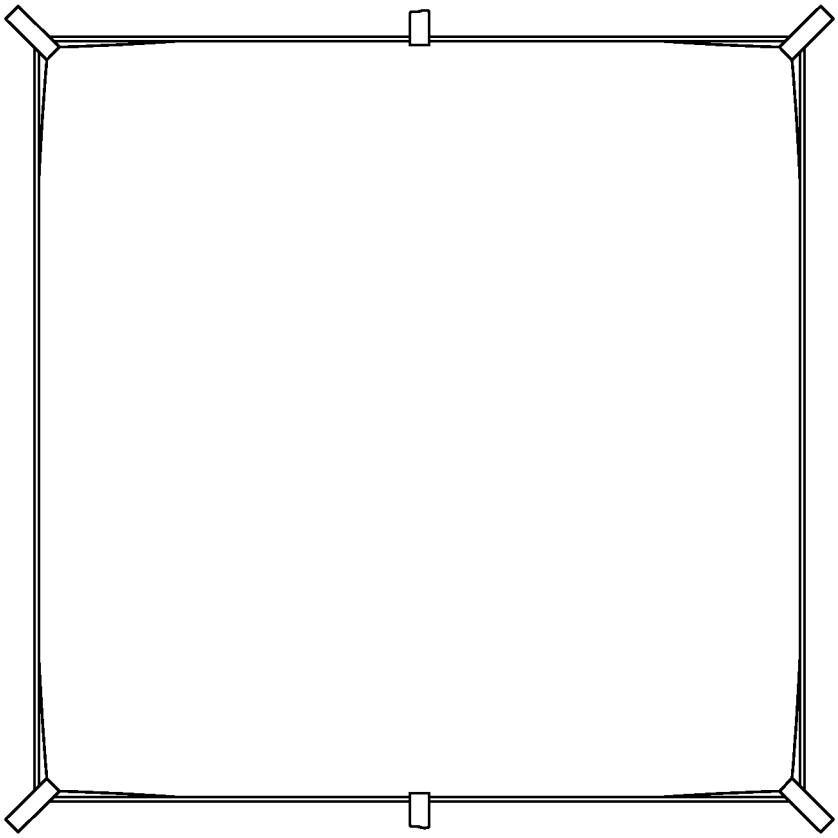
Figure 44:
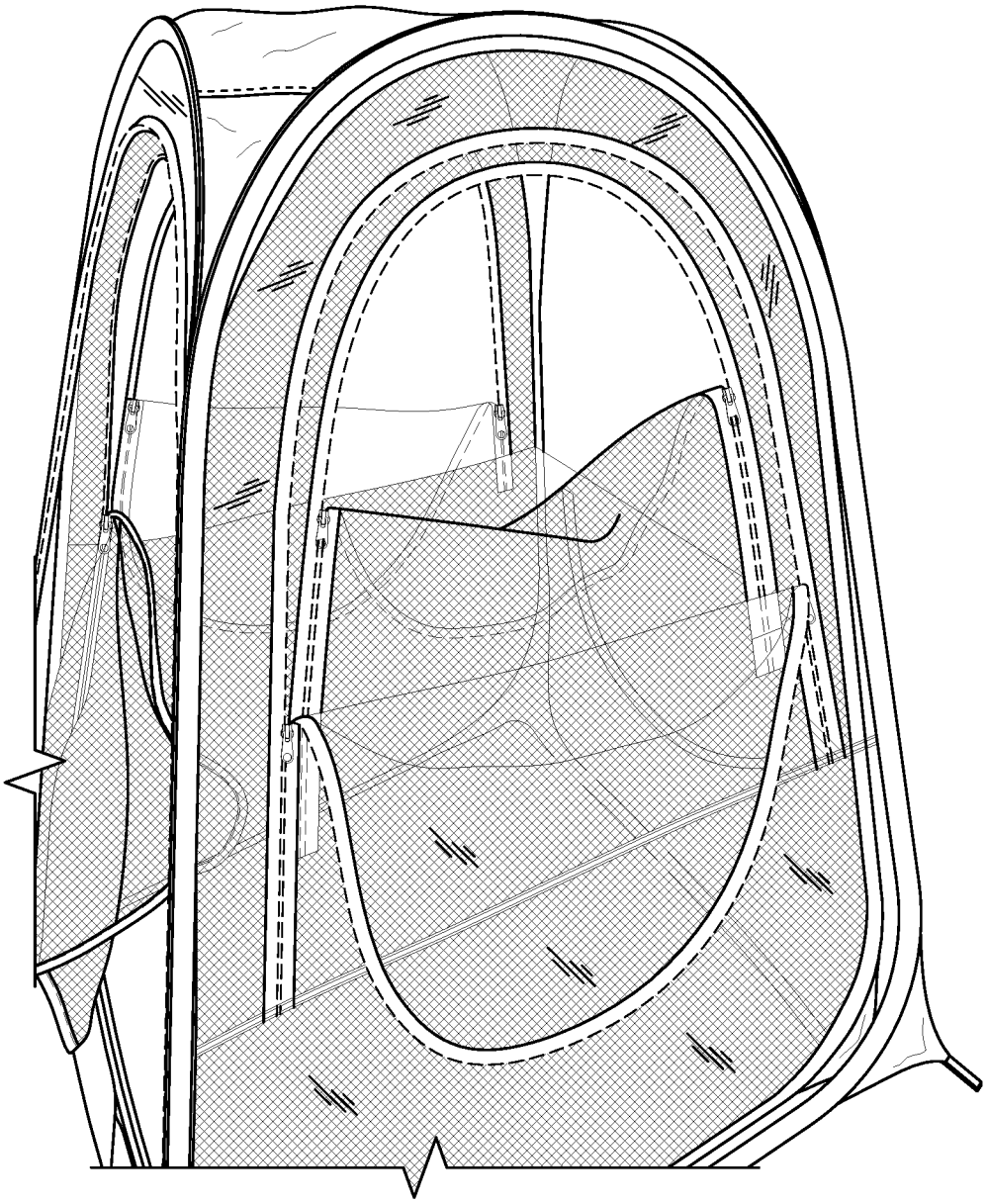
FIGS. 44-49 are photographs of an insert with parallel sides positioned inside a personal enclosure with parallel sides.
Figure 45:
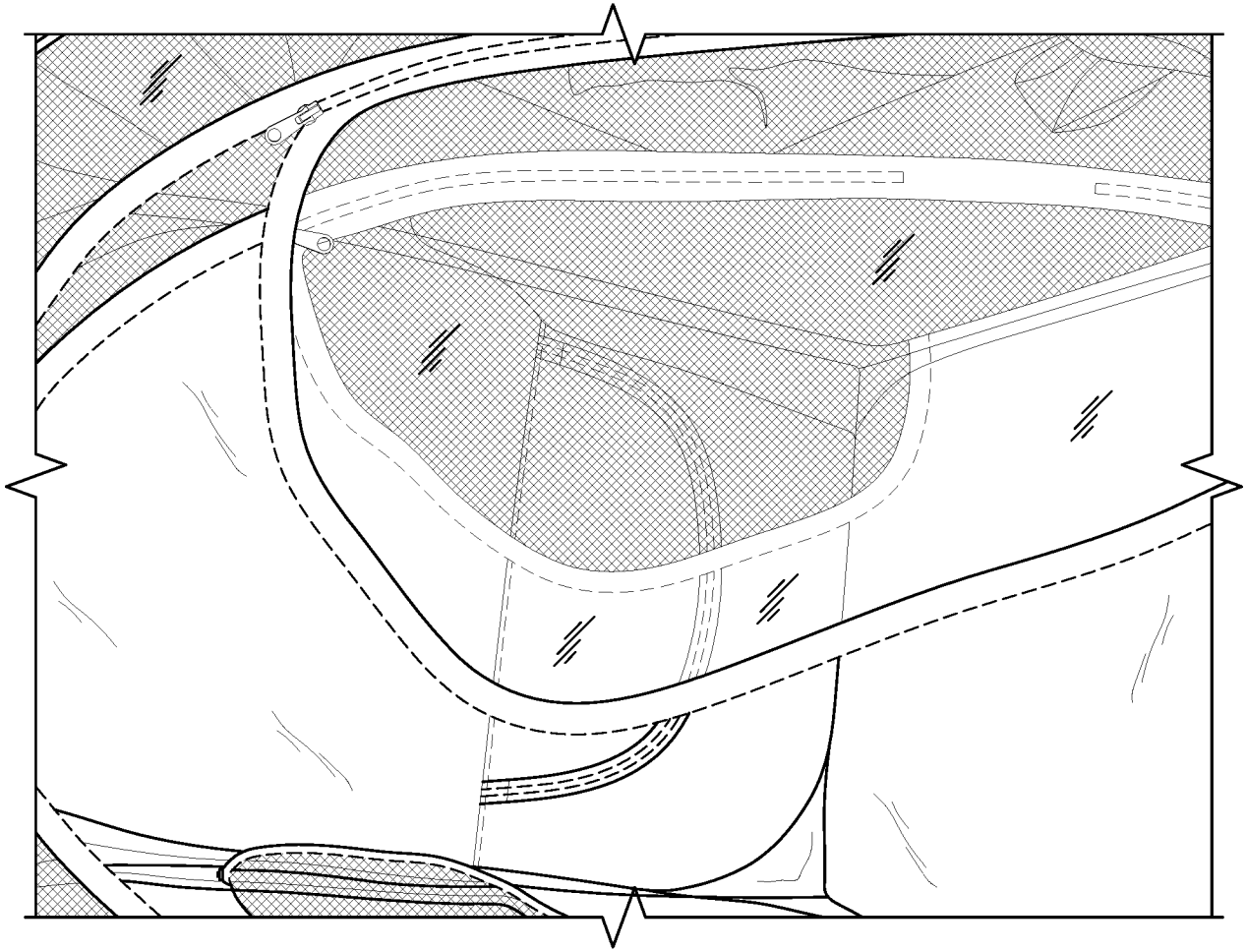
Figure 46:
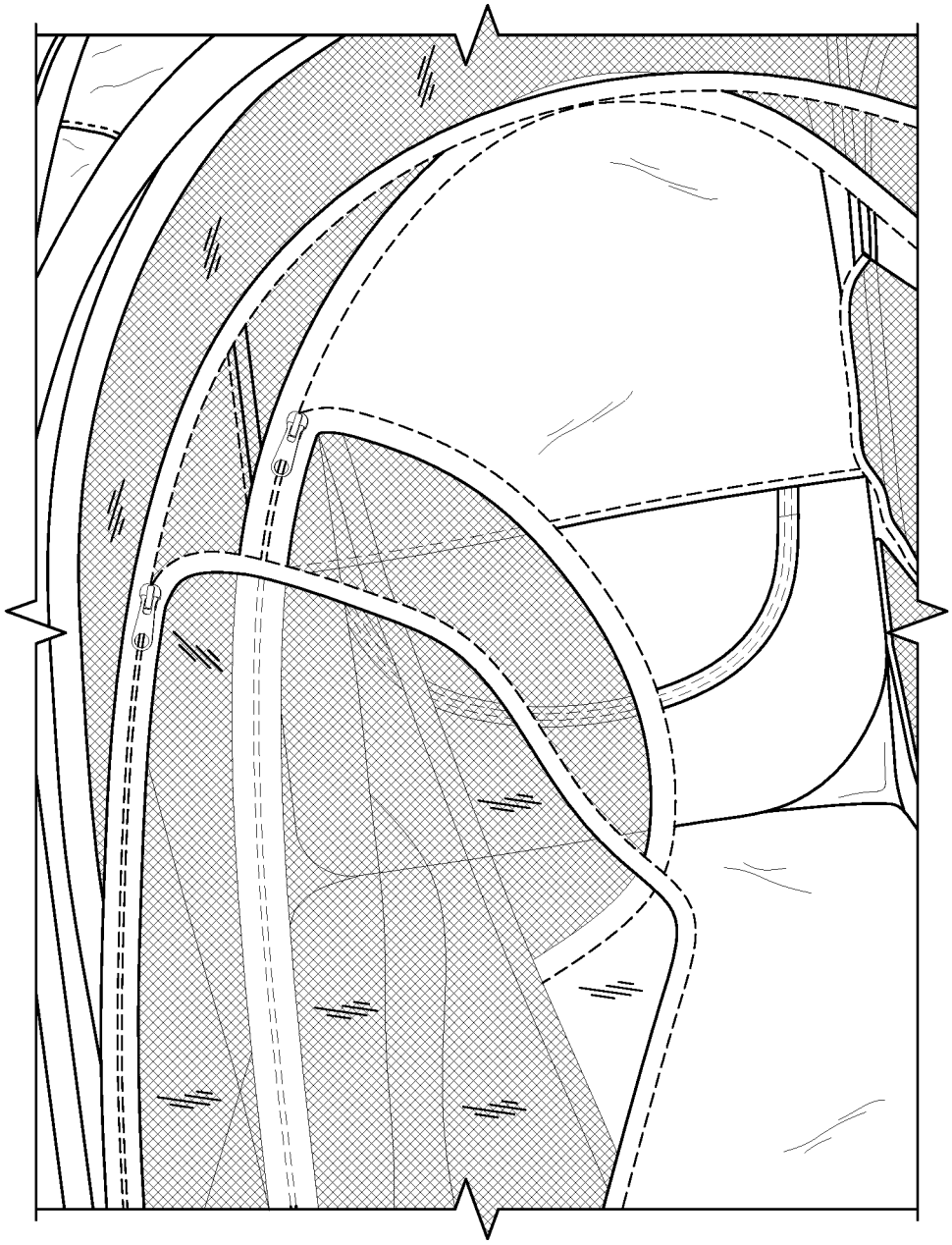

The front wall 1702 can include a door 1720 defined therein, and the first side wall 1706 can include a window 1726 defined therein. The door 1720 can be selectively engaged to the front wall 1702 via a zipper 1722. A zipper pull 1724 can be used to manipulate the zipper 1722 so that the door 1720 can be opened or closed. Similarly, the window 1726 can be selectively coupled to the first side wall 1706 via a zipper 1728. A zipper pull 1730 can be used to manipulate the window 1726 between an open and closed position. As also shown in FIG. 17, one or more reinforcement tabs 1732 can be coupled between adjacent walls to provide additional support. The tabs 1732 can couple frame members of adjacent walls in a way that the tabs clip to each frame member. In any event, the tabs 1732 provide additional support and rigidity to the overall enclosure 1700. These tabs can be used on any of the aforementioned enclosures.

As previously described, each enclosure can be designed so that it can be collapsed to a storage or transport position. This allows the enclosure to be easily stored in a trunk of a vehicle and transported to a sporting event, concert, or the like. Likewise, the enclosure can be easily configured from its collapsed, storage position to its upright position for use at the event. The frame members of each respective wall can be such that the enclosure readily and easily biases towards its upright position. This is similar to a pop-up style tent that requires no tools or assembly.

Figure 15:
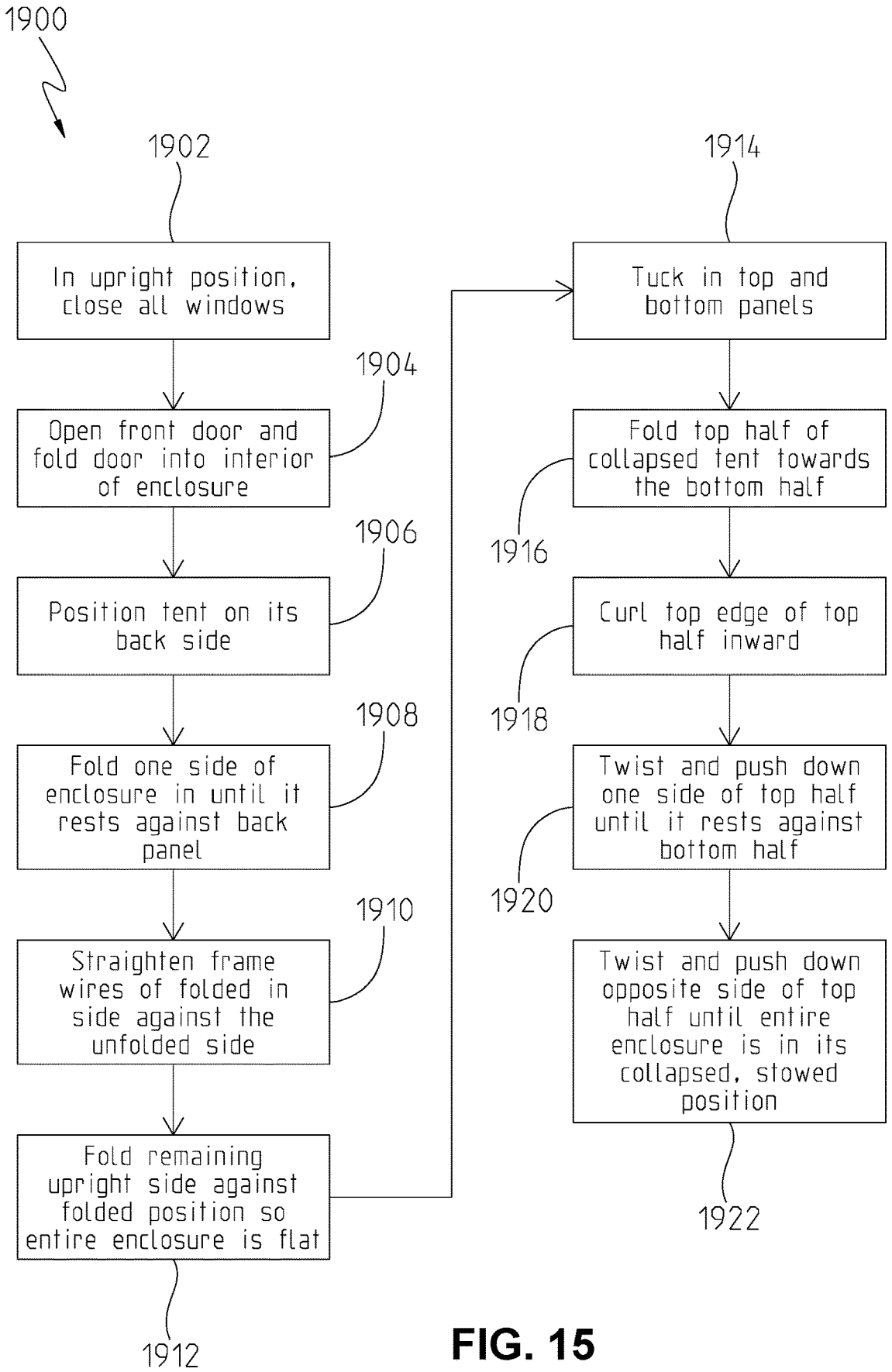
FIG. 15 is a flow diagram of a method for folding a personal enclosure from its upright position to its collapsed position.
Figure 16:
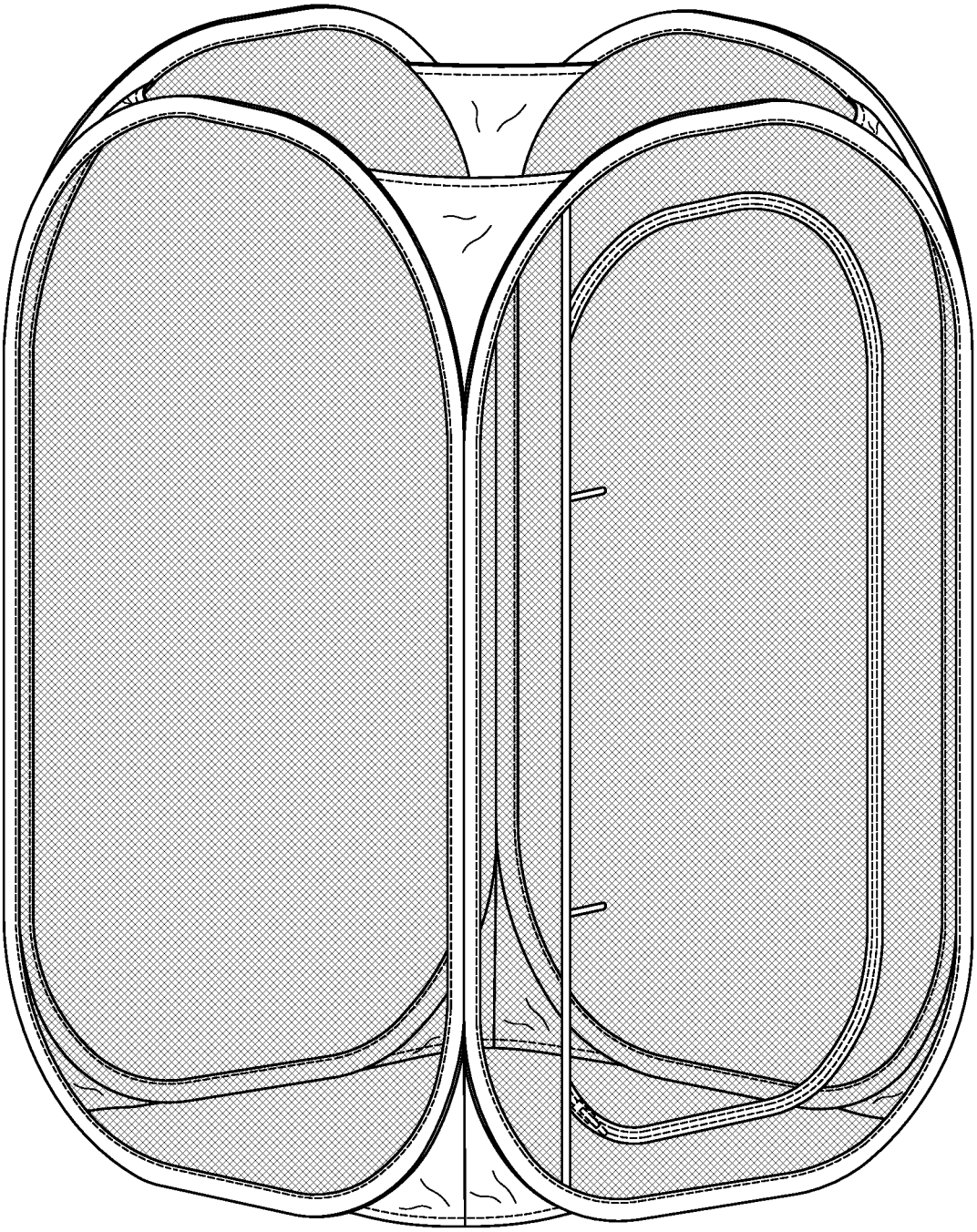
FIGS. 16-22 are figures depicting an insert with parallel sides.

Referring to FIG. 15, a process or method 1900 of folding or otherwise collapsing an upright enclosure to its stored position is shown. The method 1900 includes a plurality of blocks for execution. Each block can include one or more steps for completing the process. This process is only one example, and other methods can be used for collapsing an enclosure.

In FIG. 15, the method 1900 can be executed with the enclosure in its upright position. For purposes of this embodiment, reference will be made to the enclosure 400 of FIG. 1, but it is understood the same process can be used with any of the enclosures described in this disclosure. In block 1902, any window 600 is closed. Once all windows are closed, the method 1900 can advance to block 1904 where one of the doors is opened. In FIG. 1, for example, the front door 500 can be opened by unzipping the zipper 502 with the zipper pull 504. Once opened, the front door 500 can be folded or otherwise positioned within the interior of the enclosure 400.

Once the front door 500 is disposed in the interior of the enclosure 400, the method can advance to block 1906 where the enclosure 400 is repositioned so that the back wall 404 of the enclosure 400 is resting on the ground. In this position, the method 1900 advances to block 1908 where one side such as the first side wall 406 is folded inwardly and against the back wall 404. In doing so, the frame member 414 of the first side wall 406 can become bent or not properly aligned. Thus, in block 1910, the frame member 414 of the first side wall 406 is straightened and aligned with the frame member 414 of the back wall 404 and the frame member 414 of the second side wall 408.

Once the frame member 414 of the first side wall 406 is properly aligned, method 1900 can advance to block 1912 where the second side wall 408 can be folded inwardly and into contact with the first side wall 406. In this arrangement, the second side wall 408 is disposed on top of the first side wall 406, which is disposed on top of the back wall 408. The front wall 402 can be folded inwardly with either the first side wall 406 or the second side wall 408 such that each of the front, back, and both side walls are stacked on top of one another and the enclosure 400 is now substantially flat against the ground.

Once block 1912 is executed, method 1900 can advance to block 1914 where the top and bottom walls are tucked inbetween the front, back and side walls to form a collapsed enclosure. Method 1900 can advance to block 1916 where a user can fold a top half of the collapsed enclosure towards the bottom half thereof. With a space or gap defined between the folded over top half of the collapsed enclosure and the bottom half, in block 1918 the top edge of the top half can be curled inwardly (i.e., down) towards the bottom half. In block 1920, the method 1900 is further executed by twisting and pushing down one edge or side of the top half of the collapsed enclosure until it rests against the collapsed bottom half. In this position, block 1922 can be executed by twisting and pushing down the opposite edge or side of the top half until the entire enclosure is in its collapsed or folded configuration. In this configuration, the enclosure can be easily stored or transported. Moreover, in this position, the enclosure is roughly half or less than half its size when it was in the flat configuration of block 1912.

In the present disclosure, an enclosure can be provided or packaged as a kit. A kit can include one or more stakes that can be used to hold the enclosure securely in place with the ground. In addition, a carry case or bag can be part of the kit for storing the enclosure and stakes when the enclosure is disposed in its collapsed configuration.

FIGS. 16-49 are figures depicting inserts and such inserts inserted into personal enclosures. FIGS. 16-22 depict an insert with parallel walls and no top wall or bottom walls. The insert includes one door and three walls with no doors, windows or vents. It will be understood that the insert depicted in FIGS. 16-22 could further include additional doors or windows and vents. It will be further understood that the insert could include a top wall and bottom wall. The door of the insert can be aligned with a door of the personal enclosure to facilitate a user entering and exiting the personal enclosure. The material of the walls of the insert is a fine mesh that allows air to freely pass through the insert but restricts bugs and other insects form passing through the walls.

FIGS. 23-29 depict a personal enclosure that can also be used as an insert for personal enclosures. The insert has tapered walls, a top wall and, a bottom wall. The insert includes one door and three walls with no doors, windows or vents. It will be understood that the insert depicted in FIGS. 23-29 could further include additional doors or windows and vents. It will be further understood that the insert could be arranged without a top wall or bottom wall. The door of the insert can be aligned with a door of a tapered personal enclosure to facilitate a user entering and exiting the personal enclosure. The material of three of the walls of the insert is a fine mesh that allows air to freely pass through the insert but restricts bugs and other insects form passing through the walls. The back wall, top wall, and bottom wall of the insert are constructed of a solid material. However, it will be understood that the back wall can be made of a mesh material. The addition of a solid back wall and top wall can further shield the user from direct exposure to sunlight.

FIGS. 30-36 depict various views of an insert with parallel walls inserted into a personal enclosure with parallel walls and a roof. As is depicted, the insert occupies the full interior space of the personal enclosure and provides sufficient room for an occupant and a chair. In this arrangement, the doors and vent of the personal enclosure can be opened to facilitate air passing through the personal enclosure to cool the personal enclosure, while the insert protects the occupant against bugs and other pests.

FIGS. 37-43 depict various views of an insert with parallel walls inserted into a personal enclosure with parallel walls. As is depicted, the insert occupies the full interior space of the personal enclosure and provides sufficient room for an occupant and a chair. In this arrangement, the doors and vent of the personal enclosure can be opened to facilitate air passing through the personal enclosure to cool the personal enclosure, while the insert protects the occupant against bugs and other pests.

Figure 47:
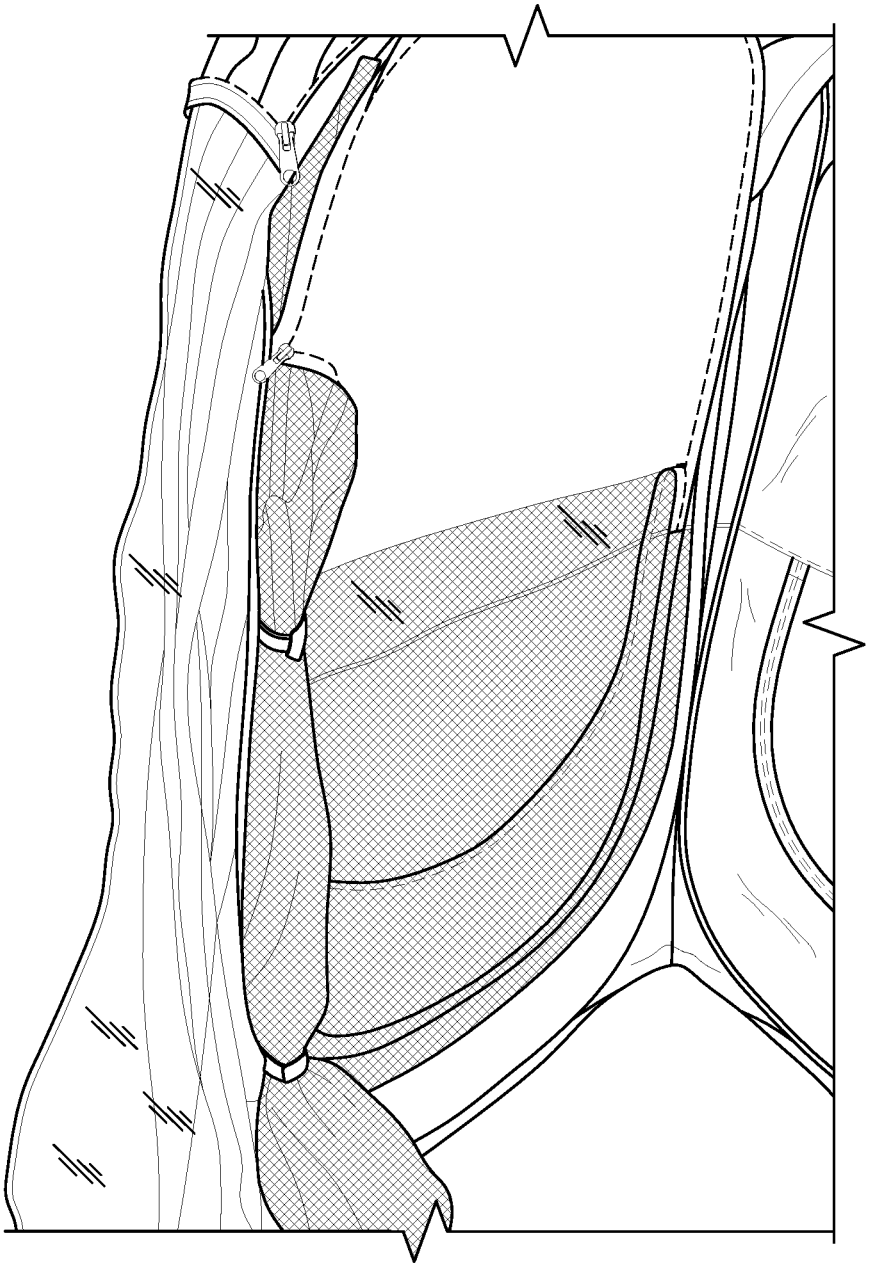
Figure 48:
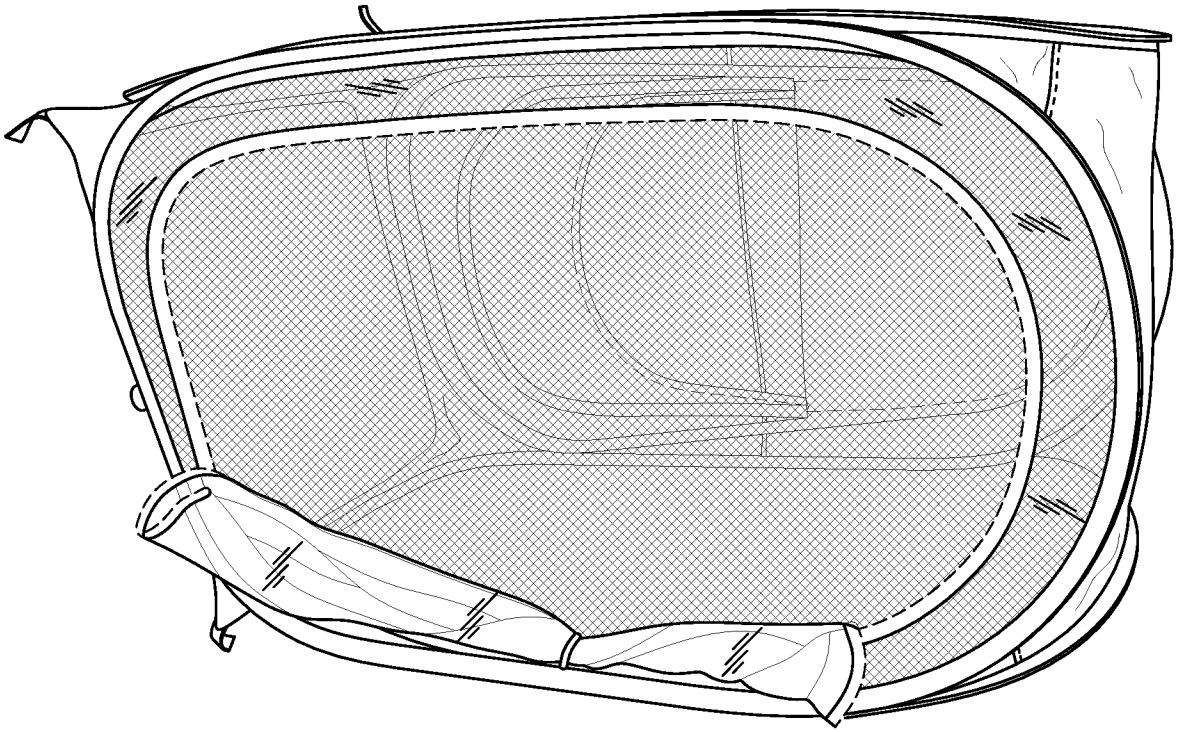
Figure 49:
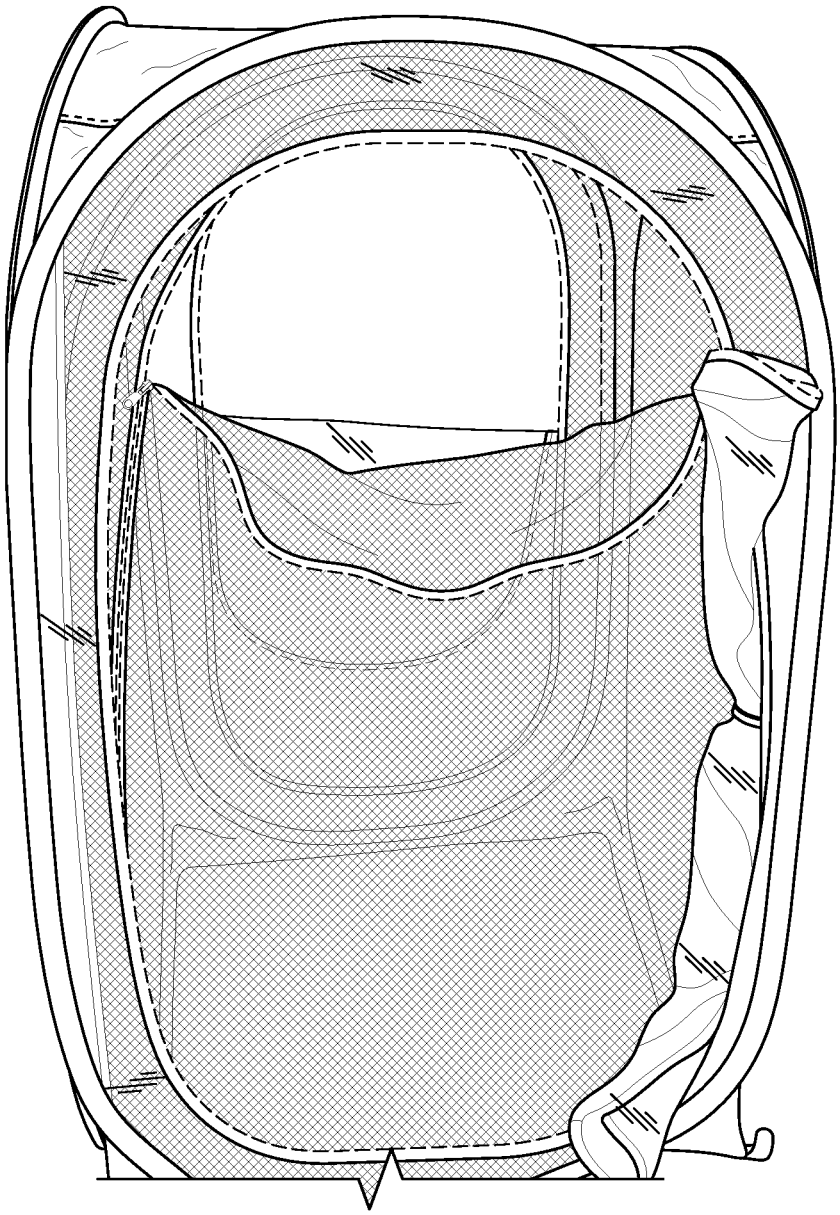

FIGS. 44-49 depict various views of a tapered insert inserted into a tapered personal enclosure. FIG. 47 depicts the door of the insert and the door of the personal enclosure secured in the open position by straps.

While exemplary embodiments incorporating the principles of the present disclosure have been disclosed hereinabove, the present disclosure is not limited to the disclosed embodiments. Instead, this application is intended to cover any variations, uses, or adaptations of the invention using its general principles. Further, this application is intended to cover such departures from the present disclosure as come within known or customary practice in the art to which this disclosure pertains and which fall within the limits of the appended claim.

The invention claimed is:

1. A personal enclosure system for accommodating a user, comprising:

a personal enclosure comprising:

an enclosure body formed by a plurality of walls including at least a front enclosure wall, a back enclosure wall, a first side enclosure wall, a second side enclosure wall, a top wall, and a bottom wall coupled to one another to form an enclosure interior;

a plurality of deformable frame members, wherein each of the front enclosure wall, the back enclosure wall, the first side enclosure wall, and the second side enclosure wall includes at least one of the plurality of deformable frame members; and a door defined in one of the front enclosure wall, back enclosure wall, first side enclosure wall, and second side enclosure wall, wherein the door is selectively engageable with the respective enclosure wall such that the door is disposable between an open and closed position; and an insert comprising:

an insert body formed by a plurality of walls including at least a front insert wall, a back insert wall, a first side insert wall, and a second side insert wall coupled to one another to form an insert interior, the insert interior configured to be occupied by the user;

a plurality of deformable frame members, wherein each of the front insert wall, the back insert wall, the first side insert wall, and the second insert side wall includes at least one of the plurality of deformable frame members; and a door defined in one of the front insert wall, back insert wall, first side insert wall, and second side insert wall, wherein the door is selectively engageable with the respective insert wall such that the door is disposable between an open and closed position;

wherein the insert is positioned entirely within the enclosure interior and the plurality of deformable frame members of the personal enclosure such that:

the front insert wall is located proximate to the front enclosure wall;

the back insert wall is located proximate to the back enclosure wall;

the first side insert wall is located proximate to the first side enclosure wall; and the second side insert wall is located proximate to the second side enclosure wall; and;

further wherein, the insert body is collapsible between an upright configuration that defines the insert interior and a collapsible configuration.

2. The personal enclosure system of claim 1, wherein:

the front enclosure wall is generally parallel to the back enclosure wall;

the first side enclosure wall is generally parallel to the second side enclosure wall; and when the insert is in the in the upright configuration:

the front insert wall is generally parallel to the back insert wall; and the first side insert wall is generally parallel to the second side insert wall.

3. The personal enclosure system of claim 1, wherein the personal enclosure is a tapered personal enclosure.

4. The personal enclosure system of claim 3, wherein the insert is a tapered insert.

5. The personal enclosure system of claim 1, wherein the front insert wall, the back insert wall, the first side insert wall, and the second side insert wall are constructed of a mesh material.

6. The personal enclosure system of claim 1, wherein the insert further comprises:

a top insert wall; and a bottom insert wall.

7. The personal enclosure system of claim 1, further comprising a removeable roof.

8. The personal enclosure system of claim 1, wherein the personal enclosure includes a window in at least the first side enclosure wall or the second side enclosure wall.

9. The personal enclosure system of claim 8, wherein the insert includes a window in at least the first side insert wall or the second side insert wall.

10. The personal enclosure system of claim 1, wherein the personal enclosure includes a vent in the back enclosure wall.

* * * * *